US010665947B2

(12) United States Patent
Pance et al.

(10) Patent No.: US 10,665,947 B2
(45) **Date of Patent: *May 26, 2020**

(54) ARRAY APPARATUS COMPRISING A DIELECTRIC RESONATOR ARRAY DISPOSED ON A GROUND LAYER AND INDIVIDUALLY FED BY CORRESPONDING SIGNAL FEEDS, THEREBY PROVIDING A CORRESPONDING MAGNETIC DIPOLE VECTOR

(71) Applicant: Rogers Corporation, Chandler, AZ (US)

(72) Inventors: Kristi Pance, Auburndale, MA (US); Karl E. Sprentall, Medford, MA (US); Roshin Rose George, Burlington, MA (US); Gianni Taraschi, Arlington, MA (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/958,508

(22) Filed: Apr. 20, 2018

(65) Prior Publication Data

US 2018/0241129 A1 Aug. 23, 2018

Related U.S. Application Data

(63) Continuation-in-part of application No. 14/881,362, filed on Oct. 13, 2015, now Pat. No. 9,985,354.
(Continued)

(51) Int. Cl.
*H01Q 9/04* (2006.01)
*H01Q 1/38* (2006.01)
(Continued)

(52) U.S. Cl.
CPC ..... *H01Q 9/0485* (2013.01); *H01Q 1/38* (2013.01); *H01Q 1/40* (2013.01); *H01Q 9/0492* (2013.01);
(Continued)

(58) Field of Classification Search
CPC ..... H01Q 9/0485; H01Q 9/0492
See application file for complete search history.

(56) References Cited

U.S. PATENT DOCUMENTS 5,940,036 A 8/1999 Oliver et al.
6,700,539 B2 * 3/2004 Lim ..... H01Q 1/40 343/700 MS
(Continued)

FOREIGN PATENT DOCUMENTS

CN 1751415 A 3/2006
JP 2004356880 A 12/2004
WO 2014073355 A1 5/2014

OTHER PUBLICATIONS

Chinese Office Action dated Mar. 3, 2019 related to U.S. Appl. No. 15/958,508; 23 pages.
(Continued)

*Primary Examiner* — Benny T Lee
(74) *Attorney, Agent, or Firm* — Cantor Colburn LLP

(57) ABSTRACT

An array apparatus includes: an electrically conductive ground layer; a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer; and, a plurality of spaced apart signal feeds disposed in one-to-one relationship with respective ones of the plurality of resonators. Each signal feed provides a respective electrical signal path through respective ones of
(Continued)

the plurality of resonators that defines an orientation of a resulting magnetic dipole vector associated with the corresponding ones of the plurality of resonators; and each pair of closest adjacent ones of the resulting magnetic dipole vectors are oriented parallel with each other but not in linear alignment with each other.

37 Claims, 18 Drawing Sheets

Related U.S. Application Data

(60) Provisional application No. 62/064,214, filed on Oct. 15, 2014.

(51) Int. Cl.
*H01Q 21/00* (2006.01)
*H01Q 21/06* (2006.01)
*H01Q 1/40* (2006.01)

(52) U.S. Cl.
CPC ..... *H01Q 21/0075* (2013.01); *H01Q 21/06* (2013.01); *H01Q 21/061* (2013.01); *H01Q 21/065* (2013.01)

(56) References Cited

U.S. PATENT DOCUMENTS

| | | | | |
|---|---|---|---|---|
| 7,995,001 | B2 | 8/2011 | Ohmi et al. | |
| 9,985,354 | B2 * | 5/2018 | Pance et al. | H01Q 9/0492 |
| 2006/0082516 | A1 | 4/2006 | Strickland | |
| 2006/0232474 | A1 | 10/2006 | Fox | |
| 2007/0164420 | A1 | 7/2007 | Chen et al. | |
| 2016/0111769 | A1 | 4/2016 | Pance et al. | |

OTHER PUBLICATIONS

Drossos, G., et al., "Four-Element Planar Arrays Employing Probe-Fed Cylindrical Dielectric Resonator Antennas," Microwave and Optical Technology Letters, vol. 18, No. 5 (Aug. 5, 1998); pp. 315-319.

Eldek, A. Abdelnasser; "Enhancement of Phased Array Size and Radiation Properties Using Staggered Array Contigurations"; Progress in Electromagnetics Research C; vol. 39; 2013; 49-60 pages.

International Preliminary Report on Patentability for International Application No. PCT/US2015/055470 date of submission Aug. 15, 2016; Date of completion of this report Jan. 23, 2017; 28 pages. (related to U.S. Appl. No. 15/958,508).

International Search Report and Written Opinion for Application No. PCT/US2015/055470 dated Jan. 19, 2016; 19 pgs. (related to U.S. Appl. No. 15/958,508).

Leung, K. W., et al, "Analysis of the Coaxial-Aperture-Fed Dielectric Resonator Antenna," Antennas and Propagation Society International Symposium (Jul. 9, 2006); pp. 2503-2506.

Leung, K. W., et al., "Low-Profile High-Permittivity Dielectric Resonator Antenna Excited by a Disk-Loaded Coaxial Aperture," Antennas and Wireless Propagation Letters, vol. 2, No. 1 (Jan. 1, 2003); pp. 212-214.

Petosa, A., et al., "Dielectric Resonator Antennas: A Historical Review and the Current State of the Art," Antennas and Propagation Magazine, vol. 52, No. 5 (Oct. 1, 2010); pp. 91-116.

United Kingdom Office Action for Application No. 1704442.1, which is related to U.S. Appl. No. 15/958,508; Report dated: Sep. 25, 2019; Report Received Date: Oct. 1, 2019; 6 pages.

Chinese Office Action dated Nov. 20, 2019 for Application No. or Patent No. 201580056087.7, Related to U.S. Appl. No. 15/958,508; with Translation; 16 pages.

* cited by examiner

ARRAY APPARATUS COMPRISING A DIELECTRIC RESONATOR ARRAY DISPOSED ON A GROUND LAYER AND INDIVIDUALLY FED BY CORRESPONDING SIGNAL FEEDS, THEREBY PROVIDING A CORRESPONDING MAGNETIC DIPOLE VECTOR

CROSS REFERENCE TO RELATED APPLICATIONS

This application is a continuation-in-part application of U.S. application Ser. No. 14/881,362 filed Oct. 13, 2015, now U.S. Pat. No. 9,985,354 with issue date May 29, 2018, which claims the benefit of U.S. Provisional Application Ser. No. 62/064,214, filed Oct. 15, 2014, all of which are incorporated herein by reference in their entirety.

BACKGROUND OF THE INVENTION

The present disclosure relates generally to an array apparatus, and particularly to an array apparatus for a very high frequency antenna.

Newer designs and manufacturing techniques have driven electronic components to increasingly smaller dimensions, for example inductors on electronic integrated circuit chips, electronic circuits, electronic packages, modules and housings, and UHF, VHF, and microwave antennas. Reduction in antenna array size has been particularly problematic due to seemingly theoretical limitations in reducing a single radiator size and signal coupling between nearest neighbors in the array, and antennas have not been reduced in size at a comparative level to other electronic components.

There accordingly remains a need in the art for antenna arrays having a reduced array size with improved beam scanning. It would be a further advantage if the materials, were easily processable and integrable with existing fabrication processes.

BRIEF DESCRIPTION OF THE INVENTION

An embodiment includes an array apparatus, having: an electrically conductive ground layer; a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer; and, a plurality of spaced apart signal feeds disposed in one-to-one relationship with respective ones of the plurality of resonators. Each respective signal feed provides a respective electrical signal path through respective ones of the plurality of resonators that defines an orientation of a resulting magnetic dipole vector associated with the corresponding ones of the plurality of resonators when an electrical signal is present on the corresponding ones of the plurality of signal feeds; and each pair of closest adjacent ones of the resulting magnetic dipole vectors are oriented parallel with each other but not in linear alignment with each other.

An embodiment includes an array apparatus, having: an electrically conductive ground layer; a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer; and, a plurality of spaced apart signal feeds disposed in one-to-one relationship with respective ones of the plurality of resonators, wherein each one of the plurality of signal feeds has a slotted aperture. Each respective signal feed provides a respective electrical signal path through respective ones of the plurality of resonators that defines an orientation of a resulting magnetic dipole vector associated with the corresponding ones of the plurality of resonators when an electrical signal is present on the corresponding ones of the plurality of signal feeds; and each pair of closest adjacent ones of the resulting magnetic dipole vectors are oriented parallel with each other but not in linear alignment with each other.

An embodiment includes an array apparatus, having: an electrically conductive ground layer; a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer; and, a plurality of spaced apart signal feeds disposed in one-to-one relationship with respective ones of the plurality of resonators, wherein each one of the plurality of signal feeds has a slotted aperture. Each pair of closest adjacent ones of the slotted aperture associated with corresponding ones of the plurality of resonators are lengthwise oriented parallel with each other but not in linear alignment with each other.

The above features and advantages and other features and advantages are readily apparent from the following detailed description when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION

Described herein is an array apparatus and electronic devices containing the array apparatus, such as circuit materials and antennas, wherein the array apparatus uses a high dielectric constant material to form a periodic array of resonators operable in the frequency range of 20-30 GHz, 30-70 GHz, or 70-100 GHz, for example. Use of an offset signal feed to the resonators, and angling between the radiating magnetic poles, unexpectedly provides improved gain and beam scanning over comparable array antennas not employing such features. The array apparatus can further be processed by methods that are readily integrated into current manufacture methods for electronic devices.

As shown and described by the various figures and accompanying text, an array apparatus has a plurality of spaced apart dielectric resonators disposed in intimate contact with an electrically conductive ground layer. A plurality of spaced apart signal lines is disposed in one-to-one relationship with respective ones of the plurality of resonators, where each signal line is disposed in off-axis electrical signal communication with an edge portion of a respective resonator. In an embodiment, the signal line and ground layer connections to each resonator are particularly positioned relative to other resonators such that angling between the radiating magnetic poles of adjacent resonators results. The array apparatus forms the basic structure for a miniaturized very high frequency antenna having improved beam scanning.

Figure 1A:
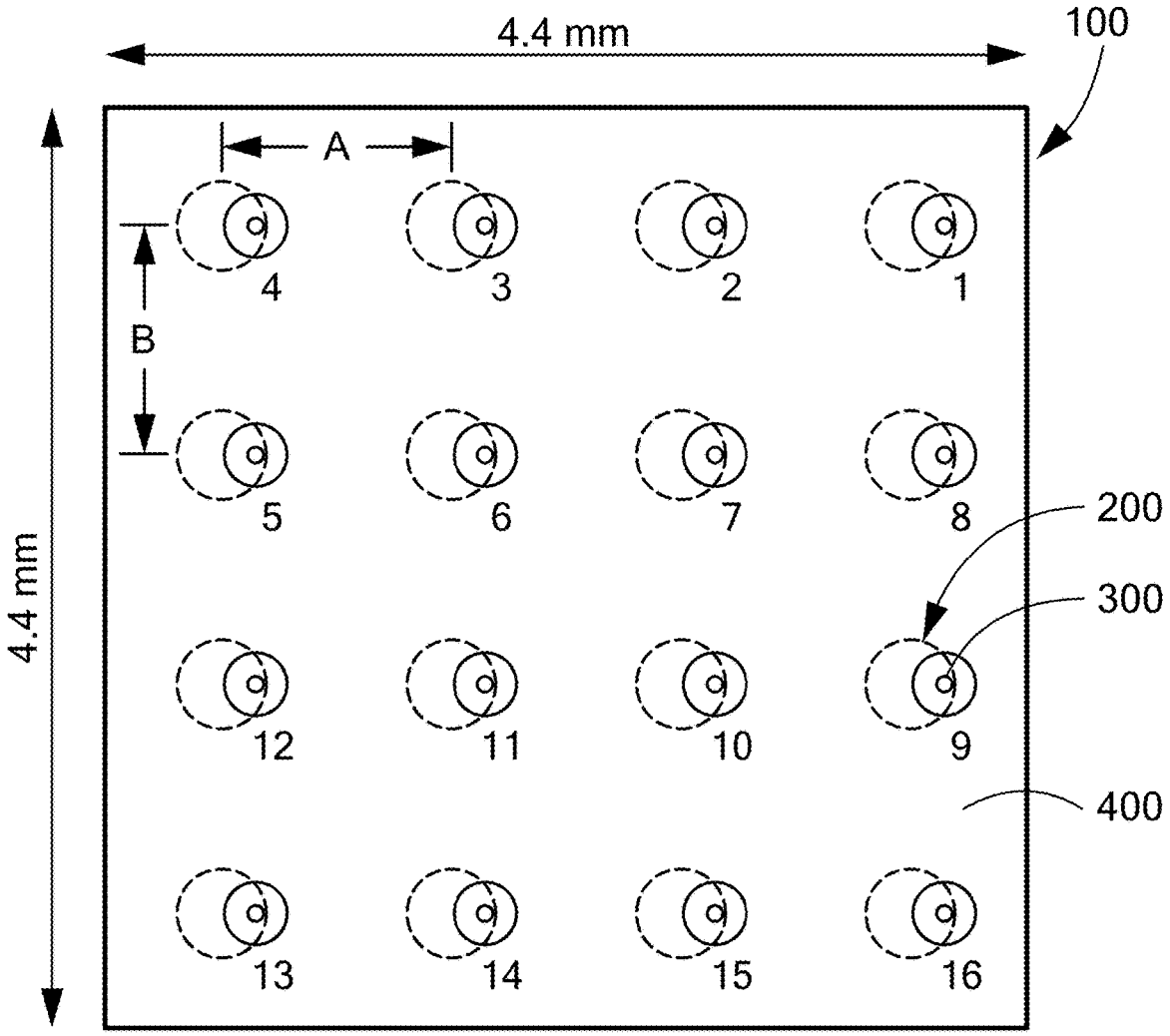
FIG. 1A depicts a transparent plan view of an 4 by 4 array apparatus, in accordance with an embodiment.
Figure 1B:
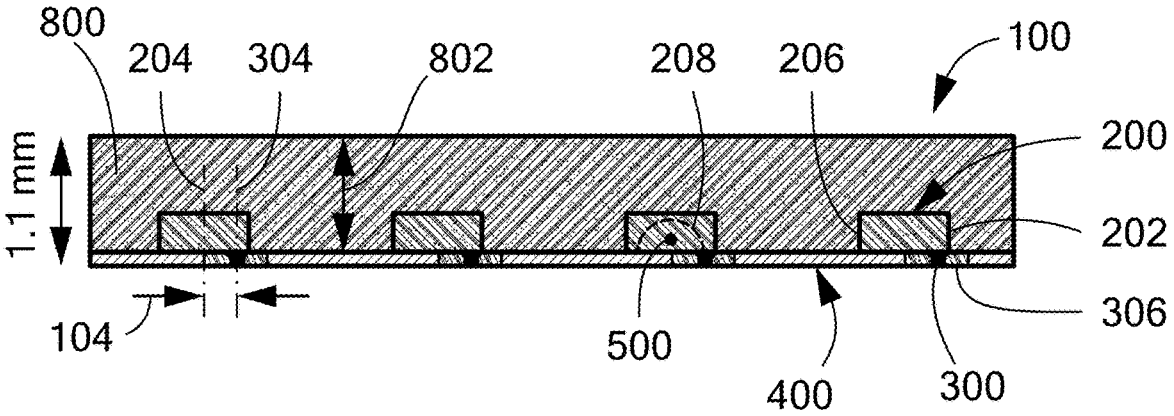
FIG. 1B depicts a transparent side view of the 4 by 4 array of FIG. 1A, in accordance with an embodiment.

FIGS. 1A and 1B depict an embodiment of an array apparatus 100 having a plurality of spaced apart dielectric resonators 200, and a plurality of spaced apart signal lines 300 disposed in one-to-one relationship with respective ones of the plurality of resonators 200, in a 4-by-4 array arrangement. While a 4-by-4 array arrangement is depicted and described herein, it will be appreciated that this is for illustration purposes only and is non-limiting to the scope of the invention, which encompasses arrays of any dimension suitable for a purpose disclosed herein. While resonators 200 are depicted and described herein with reference to a cylindrical three-dimensional form and a circular axial cross-sectional shape, it will be appreciated that other three-dimensional forms and other axial cross-sectional shapes may be employed consistent with a purpose disclosed herein. For example, each resonator may have an axial cross-section in the shape of a circle, a rectangle, a polygon, a ring, and an ellipsoid, or any other shape suitable for a purpose disclosed herein (best seen with reference to FIGS. 13A, 13B, 13C, 13D, and 13E, respectively), and may have a three-dimensional solid form in the shape of a cylinder, a polygon box, a tapered polygon box, a cone, a truncated cone, a toroid, a half-sphere, or any other three-dimensional form suitable for a purpose disclosed herein (best seen with reference to FIGS. 14A, 14B, 14C, 14D, 14E, 14F and 14G, respectively). In an embodiment, each one of the respective ones of the plurality of signal lines 300 is disposed in off-axis electrical signal communication with a first edge portion 202 of the respective ones of the plurality of resonators 200. The off-axis relationship is best seen with reference to FIG. 1B, where reference numeral 204 depicts a central axis of a representative resonator 200, and reference numeral 304 depicts a central axis of a representative signal line 300, where the two axes 204, 304 are separated (i.e., off-axis) by a distance 104. In an embodiment, each signal line 300 is disposed closer to an outer perimeter of, than to the central axis 204 of, the respective resonator 200. In an embodiment, an electrically conductive ground layer 400 is provided upon which each of the plurality of resonators 200 are disposed. In an embodiment, the ground layer 400 has a rectangular outer perimeter as depicted in FIG. 1A, however, the profile of the outer perimeter of the ground layer 400 is not limited to just rectangular, and may be any other shape suitable for a purpose disclosed herein. In an embodiment, an encapsulating layer 800 is disposed over the plurality of resonators 200 to encapsulate the plurality of resonators 200 with respect to the ground layer 400. In an embodiment, the encapsulating layer 800 (as depicted in FIG. 1B) is a low dielectric material having a dielectric constant that is less than a dielectric constant of the plurality of resonators 200 (example dielectric materials are discussed further below). In an embodiment, the resonators 200 are made from TMM® Thermoset Microwave Materials comprising a ceramic, hydrocarbon, thermoset polymer composite, such as TMM13 available from Rogers Corporation, for example. In an embodiment, the encapsulating layer 800 is polytetrafluoroethylene (PTFE), which is a synthetic fluoropolymer of tetrafluoroethylene, and is available under the brand name Teflon™ by DuPont Co. In an embodiment, the plurality of resonators 200 are uniformly spaced apart a distance "A", "B" to form a periodic structure where "A"="B" (as depicted in FIG. 1A). In an embodiment, the distance "A", "B" between each resonator 200 is approximately defined by the radiation wavelength in the environment in which the resonators are embedded in, which can be air. However, an embodiment embeds the resonators 200 in PTFE. In an embodiment, the distance "A", "B" is approximately half of the wavelength that the resonators 200 are designed and configured to resonate at, which provides for a best gain (interference between resonators) of the array apparatus 100. However, as will be described further below, an even further improvement in gain can be achieved in an embodiment by "skewing" the magnetic dipoles in relation to adjacent closest neighboring resonators 200, thereby enabling "A" and "B" to be reduced to less than half the radiation wavelength without compromising performance, which would further reduce the overall size of the array apparatus 100.

While embodiments are depicted and described herein having resonators 200 arranged in a periodic structure, it is also contemplated that an array apparatus consistent with an embodiment disclosed herein but having resonators arranged in a non-periodic structure will also advance the field of high frequency radiating arrays.

While embodiments are disclosed herein using PTFE for the encapsulating layer 800, this is for illustration purposes only and is non-limiting to the scope of the invention, as other materials suitable for a purpose disclosed herein may be used for the encapsulating layer 800, which are described in more detail below.

Figure 2:
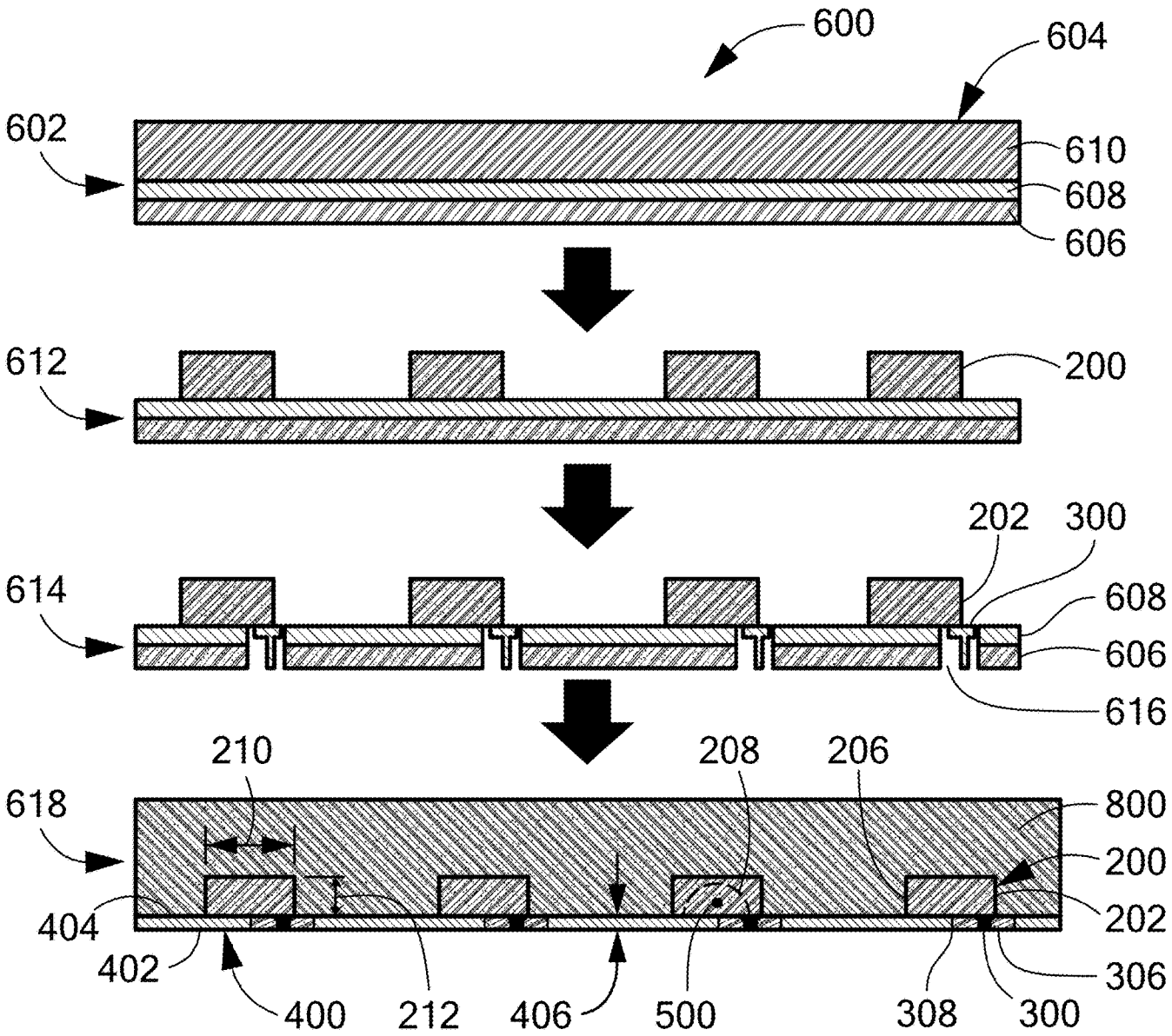
FIG. 2 depicts a fabrication process relating to the embodiment depicted in FIGS. 1A and 1B, in accordance with an embodiment.

Reference is now made to FIG. 2, which depicts a multi-step fabrication process 600 for fabricating the array apparatus 100. In step 602, a laminate 604 is provided having a substrate 606, a conductive layer 608 that forms the electrically conductive ground layer 400, and a high dielectric material layer 610 that forms the plurality of resonators 200. In step 612, portions of the high dielectric material layer 610 are removed by etching, machining, or any means suitable for a purpose disclosed herein to form the plurality of resonators 200. In step 614, portions of the substrate 606 and portions of the conductive layer 608 are removed by etching, machining, or any means suitable for a purpose disclosed herein to form non-conductive pathways 616 through the substrate 606 and the conductive layer 608, and to form the signal lines 300 that are electrically isolated from the conductive layer 608 (and the ground layer 400), while remaining in signal communication with a first (edge) portion 202 of a respective resonator 200. In step 618, the encapsulating layer 800 is disposed over the plurality of resonators 200 by any means suitable for a purpose disclosed herein, such as molding for example. In an embodiment, the signal lines 300 are formed via a coaxial cable having a ground sheath 306 insulated from the centrally disposed signal line 300 and disposed in electrical ground communication with the ground layer 400, and an outer insulation sleeve 308. As seen in FIG. 2, the ground layer 400 has a plurality of non-conductive pathways 616, which can be air or other different low dielectric constant materials, disposed in one-to-one relationship with respective ones of the plurality of signal lines 300 that provide for signal communication from one side 402 of the ground layer 400 to the other side 404 on which the plurality of resonators 200 are disposed. In an embodiment, the plurality of non-conductive pathways 616 are through-holes that extend from the one side 402 of the ground layer 400 to the other side 404.

While FIG. 2 depicts a multi-step fabrication process involving layering, etching or machining, and molding, it will be appreciated that this is for illustration purposes only, and that the scope of the invention is not so limited and includes any fabrication process suitable for a purpose disclosed herein, such as molding of the resonators 200 onto the ground layer 400 and molding of the encapsulating layer 800 over the resonators 200, for example.

While the several figures depicted herein, particularly FIG. 2, depict only three layers of materials, additional layers (not shown) of materials may optionally be present to provide desired properties consistent with a purpose of the invention disclosed herein.

While some embodiments described and illustrated herein depict a coaxial cable for the signal lines 300, this is for illustration purposes only and is non-limiting to the scope of the invention, as the signal lines 300 may be any type of signal feed suitable for a purpose disclosed herein, such as a stripline or feeder strip, a micro-strip with slotted aperture, a mini-coax, a substrate integrated waveguide (SIW), a coplanar waveguide (CPW), a corporate-type feed, or any combination of the foregoing signal feeds, for example, which will be discussed further herein below.

Example dimensions for the array apparatus 100 are provided with reference to FIGS. 1A, 1B and 2 (step 618). In an embodiment, each resonator 200 is cylindrical in shape with a diameter 210 of 0.84 mm and a height 212 of 0.4 mm, the ground layer 400 is made from copper and has a thickness 406 of 0.1 mm, the encapsulating layer 800 is made from PTFE and has a thickness 802 of 1 mm, and the array apparatus 100 has overall outside dimensions of 4.4 mm by 4.4 mm, as shown in FIG. 1A. However, these example dimensions are not considered to be limiting to the scope of the invention, as other dimensions are contemplated consistent with an embodiment and purpose of the invention disclosed herein.

With reference to FIGS. 1B, 2 (at step 618), 3A, and 3B, a second portion 206 (FIGS. 1B and 2) of each of the plurality of resonators 200 is disposed in electrical communication with the ground layer 400, the second portion 206 being different from the first portion 202, to provide a signal path 208 (FIGS. 1B and 2) through each of the plurality of resonators 200 that defines an orientation of a resulting magnetic dipole 500 associated with respective ones of the plurality of resonators 200 when an electrical signal is present of each of the plurality of signal lines 300.

Figure 3A:
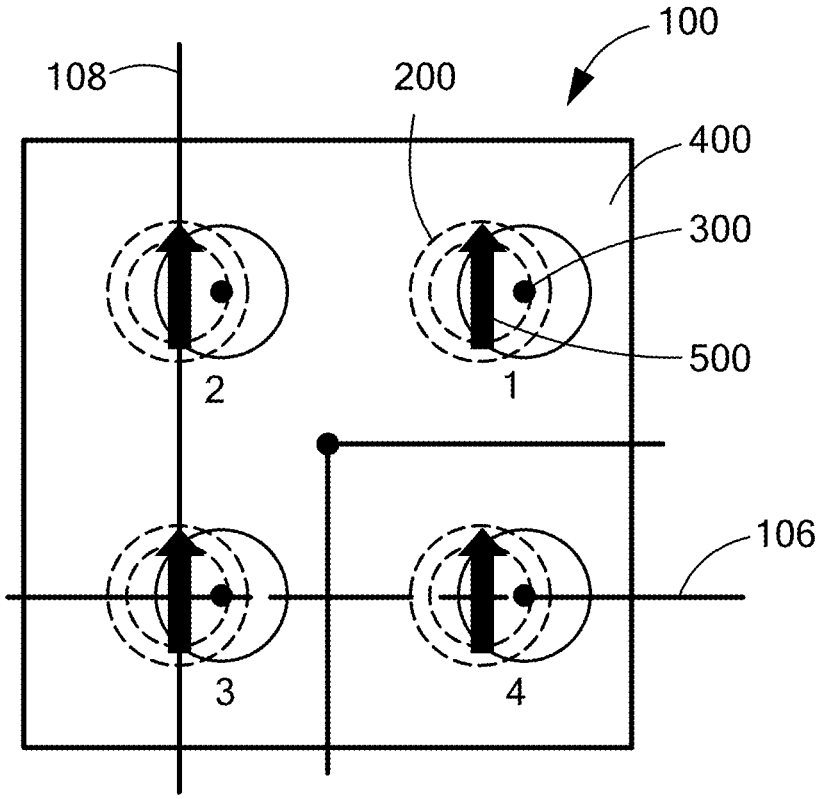
FIG. 3A depicts a transparent plan view of a 2 by 2 portion of the array apparatus of FIG. 1A showing the orientation of resulting magnetic dipoles with offset signal feeds and non-skewed magnetic dipoles, in accordance with an embodiment.

FIG. 3A depicts an array apparatus 100 where horizontally paired closest neighboring resonators 200 are arranged relative to each other such that the centers of each respective resonator 200 and the centers of each respective signal line 300 are disposed in linear alignment with each other, as indicated by reference line 106, and where vertically paired closest neighboring resonators 200 are arranged relative to each other such that the respective magnetic dipole vectors 500 are disposed in linear alignment with each other, as indicted by reference line 108, which results in closest adjacent neighboring magnetic dipoles 500 being non-skewed relative to each other. As depicted in FIG. 3A, the resulting reference lines 106 and 108 are orthogonal to each other.

Figure 3B:
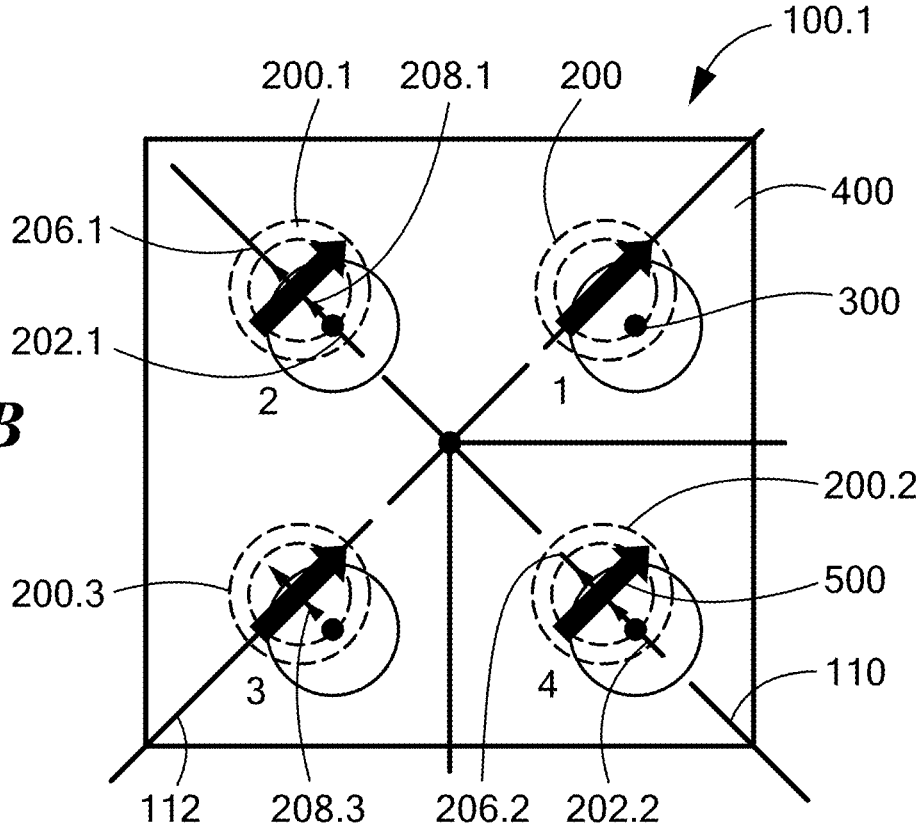
FIG. 3B depicts an alternative array apparatus to that of FIG. 3A showing the orientation of resulting magnetic dipoles with offset signal feeds and skewed magnetic dipoles, in accordance with an embodiment.

FIG. 3B depicts an array apparatus 100.1 where a superposition of the above noted reference lines 106, 108 (FIG. 3A) would not have the above noted structural arrangement of resonators 200, signal lines 300 and resulting magnetic dipole vectors 500. Alternatively, FIG. 3B depicts an array apparatus 100.1 where a first pair of diagonally paired non-closest neighboring resonators 200 are arranged relative to each other such that the centers of each respective resonator 200 and the centers of each respective signal line 300 are disposed in linear alignment with each other, as indicated by reference line 110, and where a second pair of diagonally paired non-closest neighboring resonators 200 are arranged relative to each other such that the respective magnetic dipole vectors 500 are disposed in linear alignment with each other, as indicted by reference line 112.

The array apparatus 100.1 depicted in FIG. 3B is herein referred to as having magnetic dipoles 500 "skewed" in relation to adjacent closest neighboring resonators 200. Whereas the array apparatus 100 depicted in FIG. 3A is herein referred to as having "non-skewed" magnetic dipoles 500, or as having "aligned" vertically paired closest neighboring magnetic dipoles 500. The non-skewed arrangement depicted in FIG. 3A results in a strong interaction between the dipoles 500 as compared to the skewed arrangement depicted in FIG. 3B, which in relative terms has a weak interaction between the dipoles 500.

The skewed relationship depicted in FIG. 3B can be described another way with respect to the first and second portions 202, 206 (FIGS. 1B and 2) of a pair of diagonally paired non-closest neighboring resonators 200, where the first and second portions 202.1, 206.1 of a first non-closest neighboring resonator 200.1 are oriented in linear alignment with the diagonally disposed first and second portions 202.2, 206.2 of a respective second non-closest neighboring resonator 200.2, as seen with reference to reference line 110.

The skewed relationship depicted in FIG. 3B can be described another way with respect to the signal paths 208 (FIGS. 1B and 2) through each of the plurality of resonators 200, which as described above define an orientation of a resulting respective magnetic dipole 500 associated with respective ones of the plurality of resonators 200 when an electrical signal is present of each of the plurality of signal lines 300. In the skewed arrangement, a signal path 208.1 of a given resonator 200.1 is oriented out of linear alignment with respect to another signal path 208.3 of a respective closest adjacent neighboring resonator 200.3. In the skewed relationship, this non-linear alignment of signal paths 208 is true for each pair of closest adjacent neighboring resonators 200.

The skewed relationship can be described in another way as an attempt to increase the "electromagnetic" distance of the magnetic dipoles by preserving the same "physical" distance of their sources (the radiators). So, the resonators remain in the same distance, but their respective dipoles are "pushed" further apart. It is done by "angling" somewhere between zero-degrees and ninety-degrees the directions of the feeding mechanism and the directions defined by nearest neighbors (vertical and horizontal). From the point of view of dipole-dipole interaction, the strongest coupling in the "skewed" configuration should be the diagonal coupling depicted in FIG. 3B by resonators 200.3 and 200. However, it is clear that this "physical" distance is larger (diagonal of the square defined by radiators).

Another way to describe the "skewing" effect is by considering again the minimal standard distance between the radiators in array. We mention that for the best constructive interference in the far field (gain) this distance should be around half of the wavelength. The reason for this is the radiation "detaching" mechanism, which describes the separation of the EM field lines from the source and happens during a half period T/2 where T is the radiation period. During this amount of time the field lines are still connected to the source (radiator) and the interaction with another source (another radiator) should be minimized. The "skewing" effect realizes exactly this. It effectively increases the "electric" distance without changing any "physical" distance.

Figure 4A:
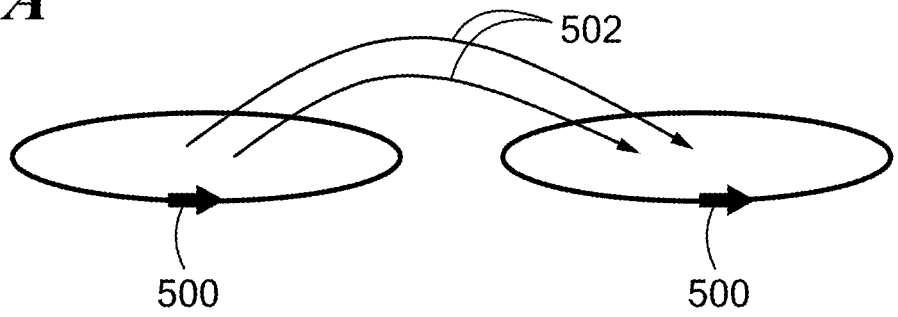
FIGS. 4A and 4B depict visual interpretations of the magnetic coupling between adjacent closest neighboring resonators in relation to the non-skewed magnetic dipole embodiment of FIG. 3A, in accordance with an embodiment.
Figure 4B:
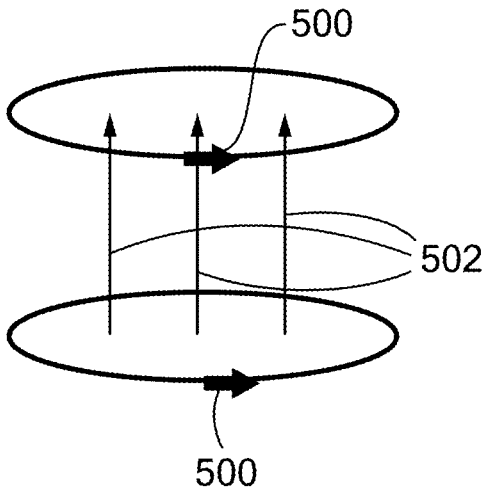
Figure 4C:
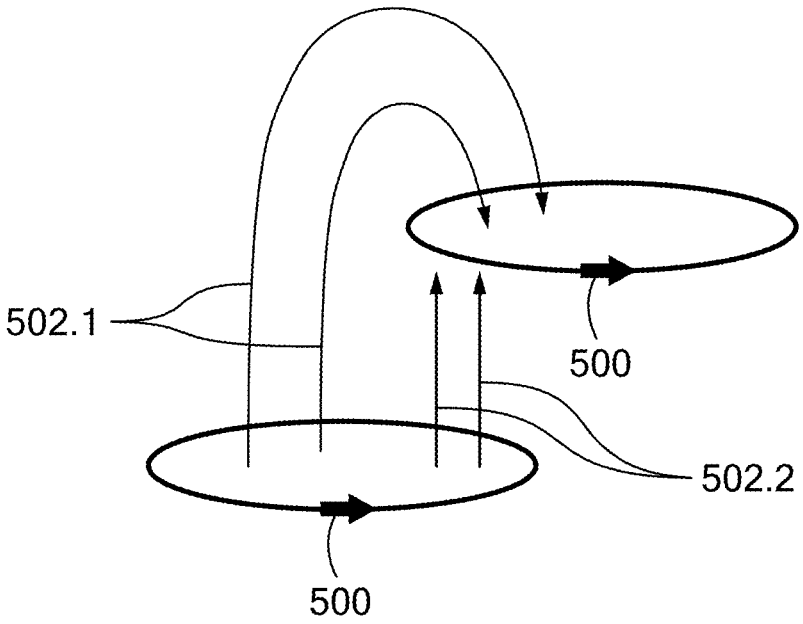
FIG. 4C depicts a visual interpretation of the magnetic coupling between adjacent closest neighboring resonators in relation to the skewed magnetic dipole embodiment of FIG. 3B, in accordance with an embodiment.

Reference is now made to FIGS. 4A, 4B, and 4C, where FIGS. 4A and 4B depict visual interpretations of magnetic dipole arrangements 500 (depicted as loops) according to the above described non-skewed arrangement of FIG. 3A, and where FIG. 4C depicts a visual interpretation of a magnetic dipole arrangement according to the above described skewed arrangement of FIG. 3B. In the arrangement of FIGS. 4A, 4B there is a strong coupling between the closest adjacent neighboring resonators as all the magnetic field lines 502 from one loop that go through the region confined by the closest adjacent neighboring loop go through in the same direction. Whereas in the arrangement of FIG. 4C there is a weak coupling between closest adjacent neighboring resonators 200 (FIG. 1A) as not all of the magnetic field lines from one loop that go through the region confined by the closest adjacent neighboring loop go through in the same direction, as depicted by magnetic field lines 502.1, 502.2 passing through a closest adjacent neighboring loop in opposite directions, which results in a cancellation of the magnetic fluxes, and a very weak or zero interaction between closest adjacent neighboring resonators 200.

Reference is now made to FIGS. 5-8, which illustrate simulated performance characteristics of an embodiment of the invention disclosed herein. All simulations were performed using a 4-by-4 array (see FIG. 1A) at 77 GHz in phase excitation to each resonator 200.

Figure 5:
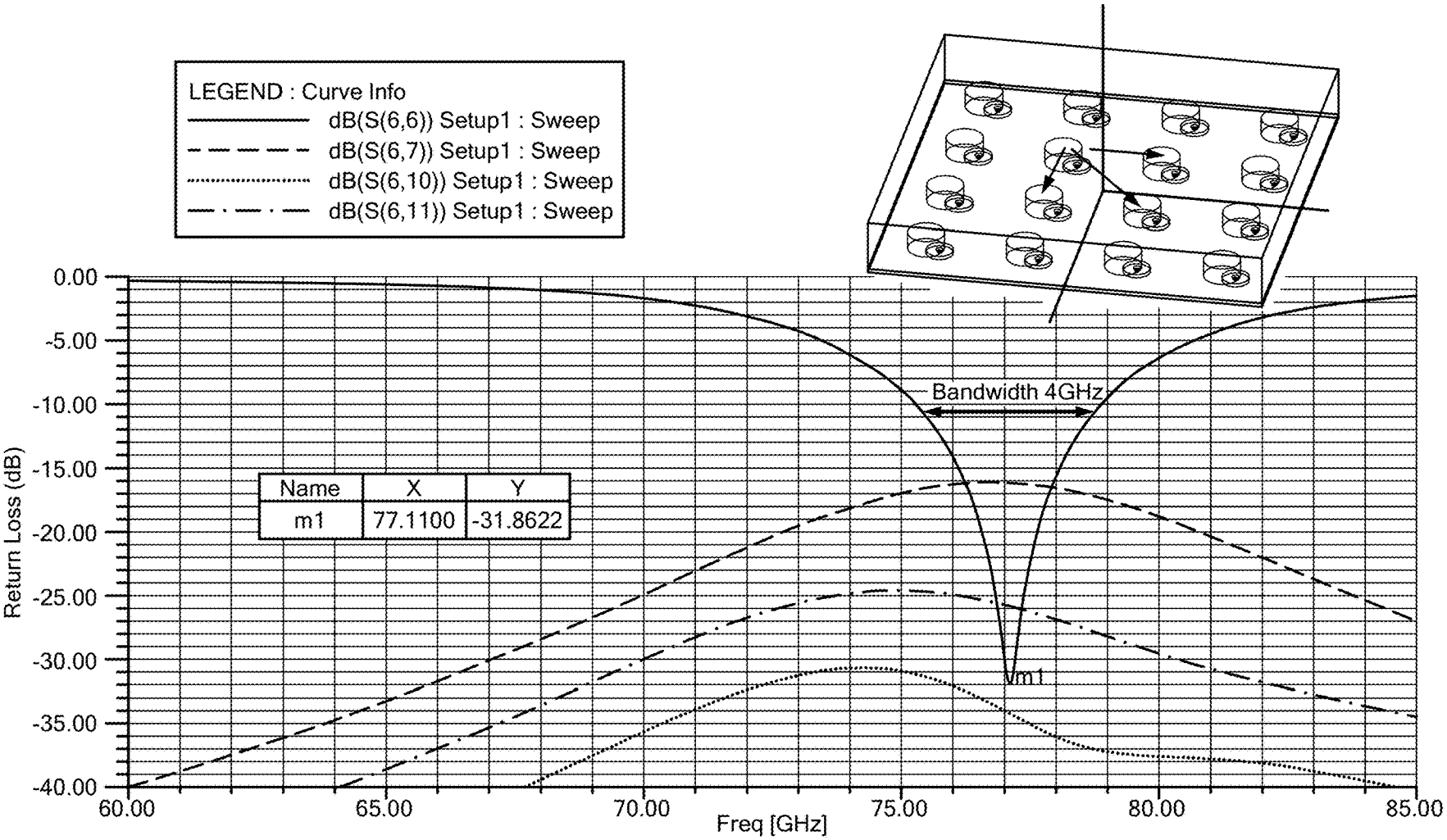
FIG. 5 depicts simulation data for return loss S11 and couplings between closest adjacent neighboring resonators for the embodiment of FIG. 1A, in accordance with an embodiment.

FIG. 5 depicts simulation data for the coupling and return loss S11 in dB vs. Frequency in GHz between closest adjacent neighboring resonators 200 for an array apparatus 100 consistent with that depicted and described with reference to FIGS. 1A, 1B and 3A, that is, an array apparatus 100 with offset signal feeds to the resonators 200, and without the magnetic dipoles 500 being skewed. As depicted in FIG. 5, the "Legend: Curve Info" box relates the illustrated return loss data curves S(6, 6), S(6, 7), S(6, 10), and S(6, 11) to the corresponding resonator locations 6, 7, 10, and 11, depicted in FIG. 1A. Here, the return loss S11 at 77 GHz is seen to be −31 dB. In comparison, an otherwise similar array apparatus, but absent the offset signal feeds as herein disclosed and described, would have a return loss S11 on the order of −10 dB over a 4 GHz bandwidth (see comparative data discussed below in relation to FIG. 9), which would result in a lot more magnetic energy being reflected back to the originating resonator 200 as opposed being radiated outward. As will be described below with reference to FIGS. 7 and 8, the interaction between closest adjacent neighboring resonators 200 can be reduced from −18 dB to −26 dB by also implementing an arrangement where the magnetic dipoles 500 are skewed.

Figure 6:
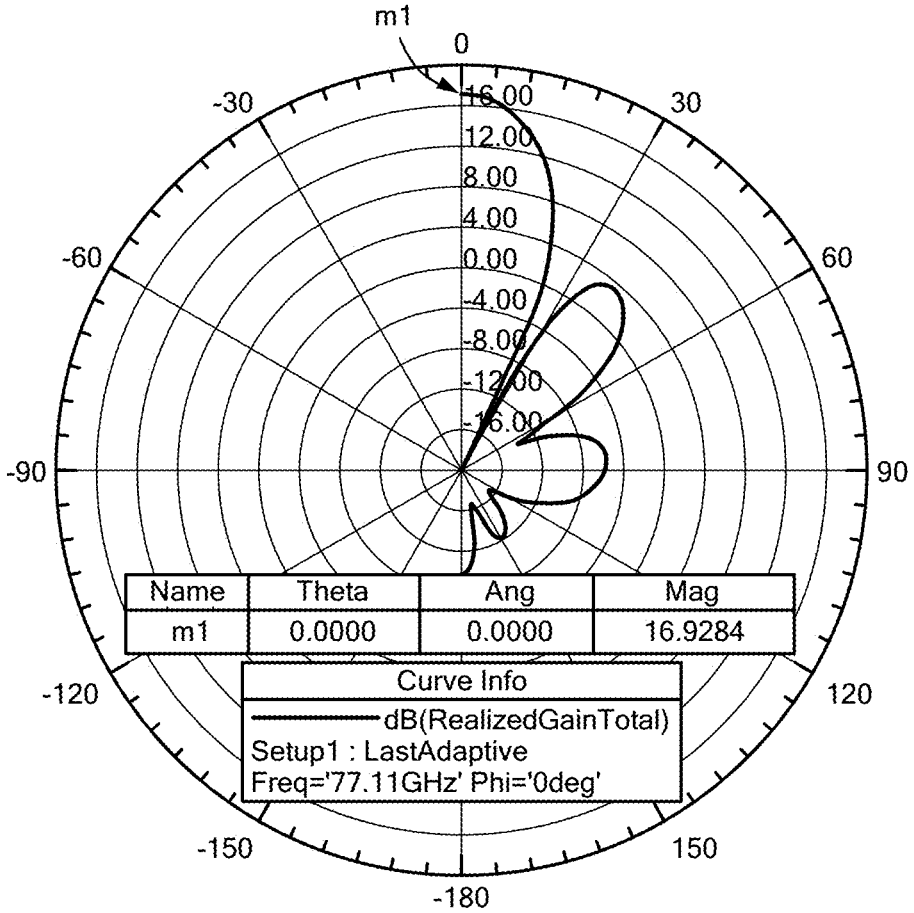
FIG. 6 depicts simulation data for gain for the embodiment of FIG. 1, in accordance with an embodiment.
Figure 6:
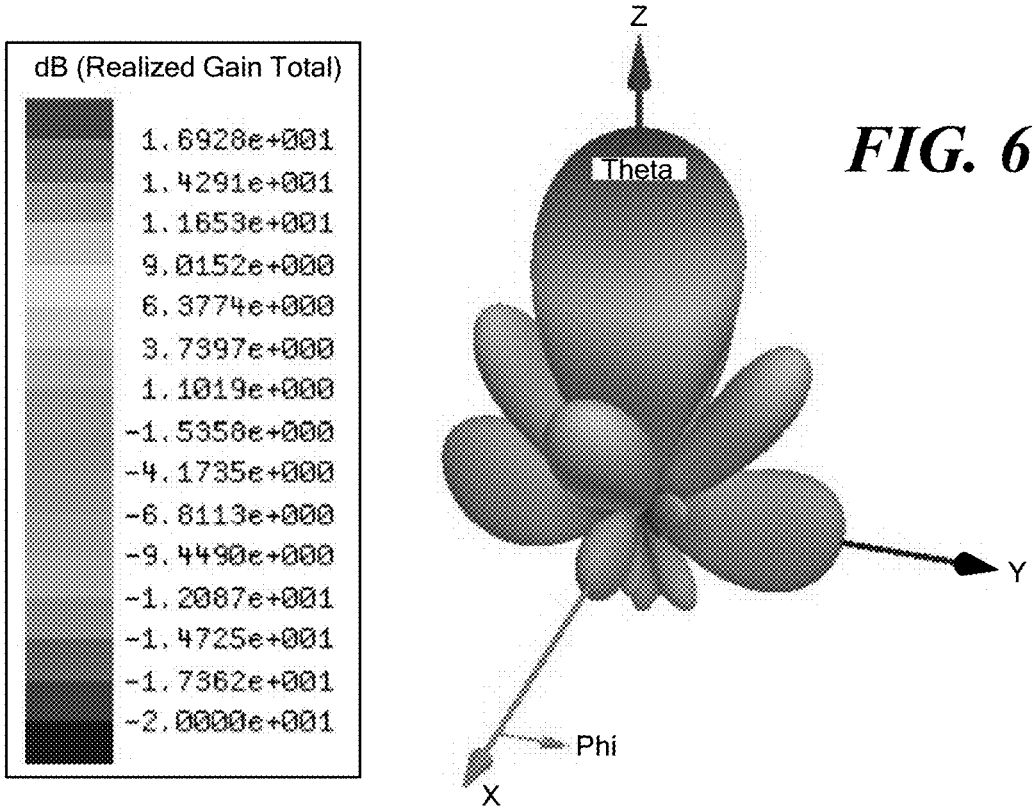

FIG. 6 depicts simulation data for the gain of a 4 by 4 array apparatus 100 as herein described with offset signal feeds to the resonators 200, and without the magnetic dipoles 500 being skewed (see FIG. 3A). Here, the gain at the boresight (i.e. angle theta=0 degrees) is seen to be 17 dB at 77 GHz. The gain for an 8 by 8 array apparatus 100 having overall outside dimensions of 10 mm by 10 mm is calculated to be 23-24 dB. A comparison to non-offset, or only slightly offset, signal feeds is provided below with reference to FIGS. 9-12. As depicted in FIG. 6, the "Curve Info" legend box identifies the illustrated curve to be Realized Total Gain in dB at 77.11 GHz and at angle Phi=0 degrees.

Figure 7:
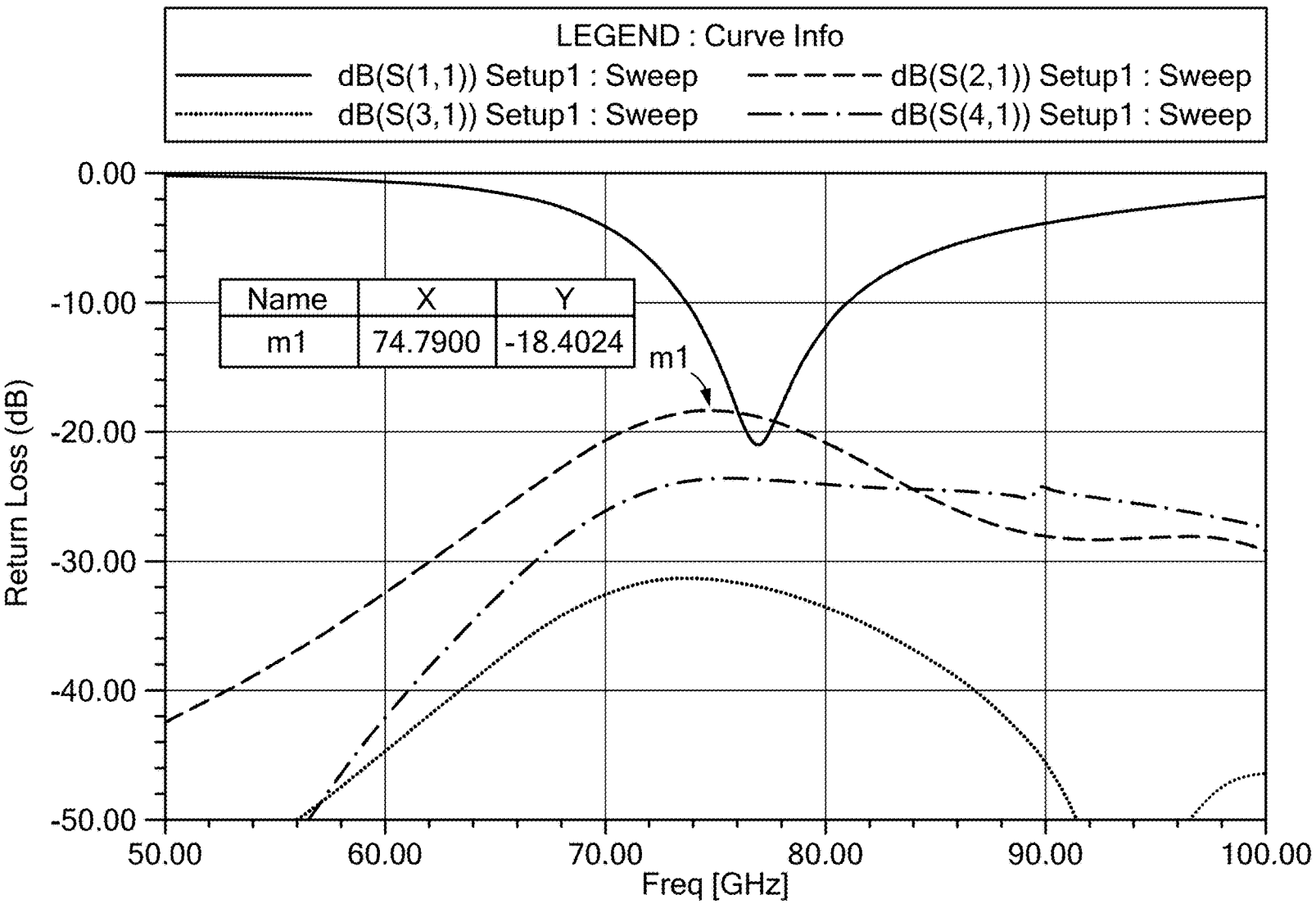
FIG. 7 depicts simulation data for the interaction between closest adjacent neighboring resonators for the embodiment of FIG. 3A, in accordance with an embodiment.

FIG. 7 depicts simulation data for return loss S11 in dB vs. Frequency in GHz for the interaction between closest adjacent neighboring resonators 200 for an array apparatus 100 with offset signal feeds to the resonators 200, and without the magnetic dipoles 500 being skewed (see FIG. 3A). Here, the interaction is seen to be −18 dB at about 74 GHz. As depicted in FIG. 7, the "Legend: Curve Info" box relates the illustrated return loss data curves S(1, 1), S(2, 1), S(3, 1), and S(4, 1) to the corresponding resonator locations 1, 2, 3, and 4, depicted in FIG. 3A.

Figure 8:
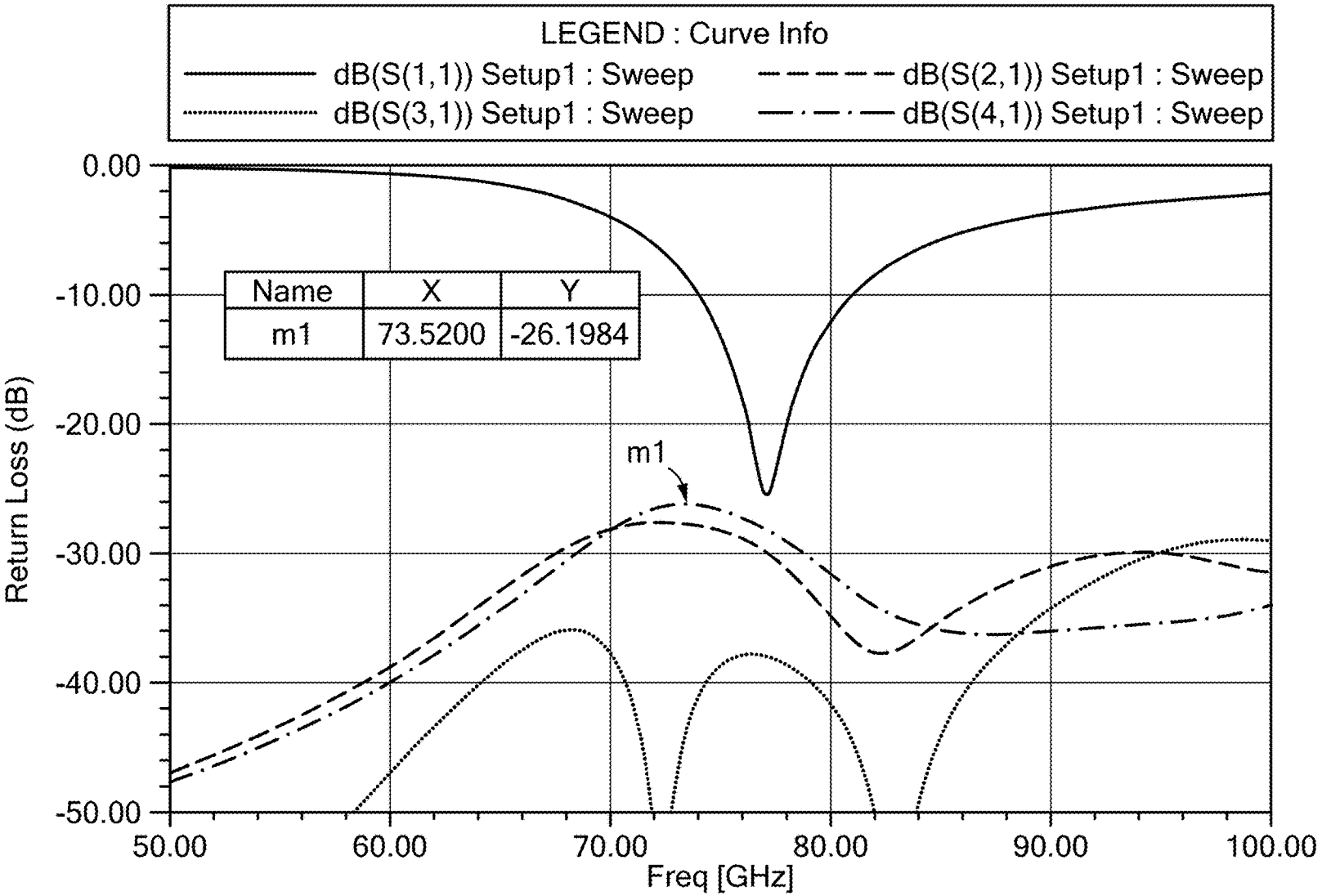
FIG. 8 depicts simulation data for the interaction between closest adjacent neighboring resonators for the embodiment of FIG. 3B, in accordance with an embodiment.

FIG. 8 depicts simulation data for return loss S11 in dB vs. Frequency in GHz for the interaction between closest adjacent neighboring resonators 200 for an array apparatus 100 with offset signal feeds to the resonators 200, and with the magnetic dipoles being skewed (see FIG. 3B). Here, the interaction is seen to be −26 dB at about 76 GHz, which is an 8 dB improvement over the arrangement of FIG. 7. As depicted in FIG. 8, the "Legend: Curve Info" box relates the illustrated return loss data curves S(1, 1), S(2, 1), S(3, 1), and S(4, 1) to the corresponding resonator locations 1, 2, 3, and 4, depicted in FIG. 3B.

By reducing the coupling while improving the interaction between closest adjacent neighboring resonators 200, a greater constructive magnetic interference will result, which will provide for a reduction in the array size with improved beam scanning performance.

Figure 9:
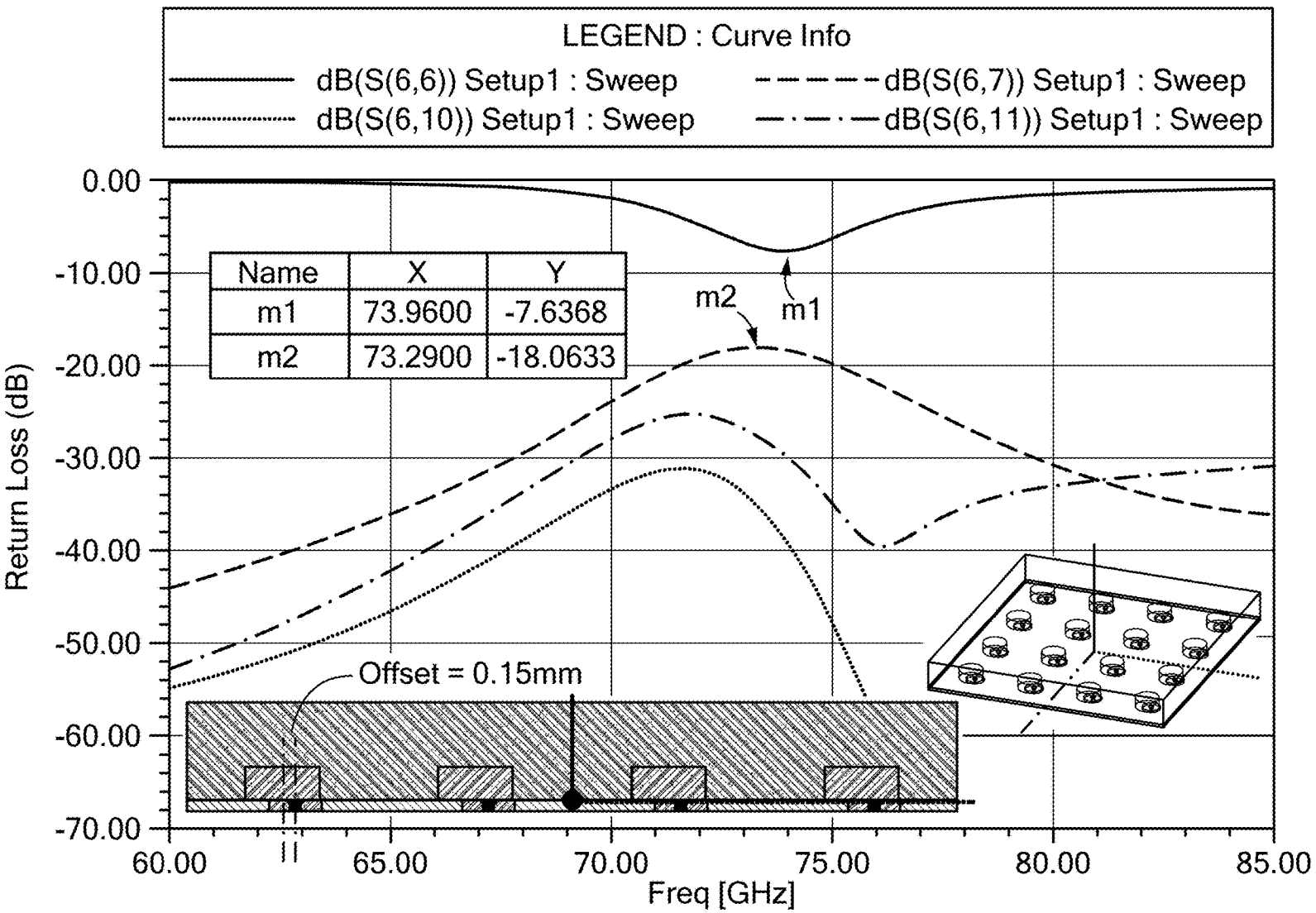
FIG. 9 depicts simulation data in comparison to FIG. 5 for a lesser offset signal feed.
Figure 10:
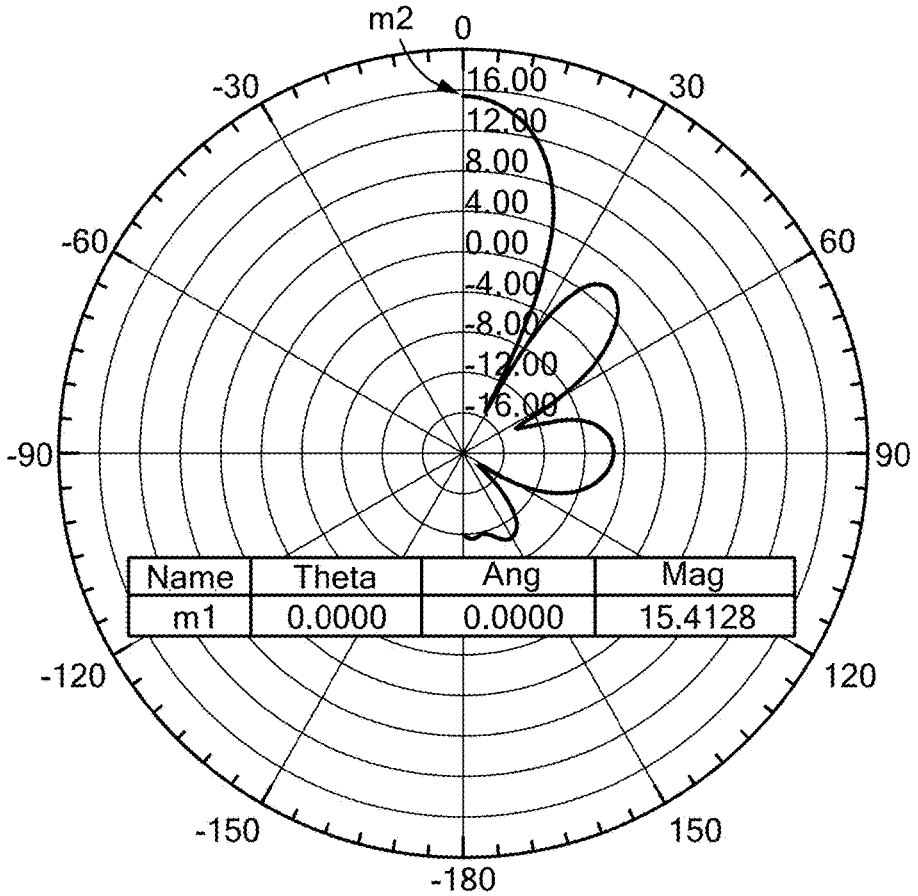
FIG. 10 depicts simulation data in comparison to FIG. 6 for a lesser offset signal feed.
Figure 10:
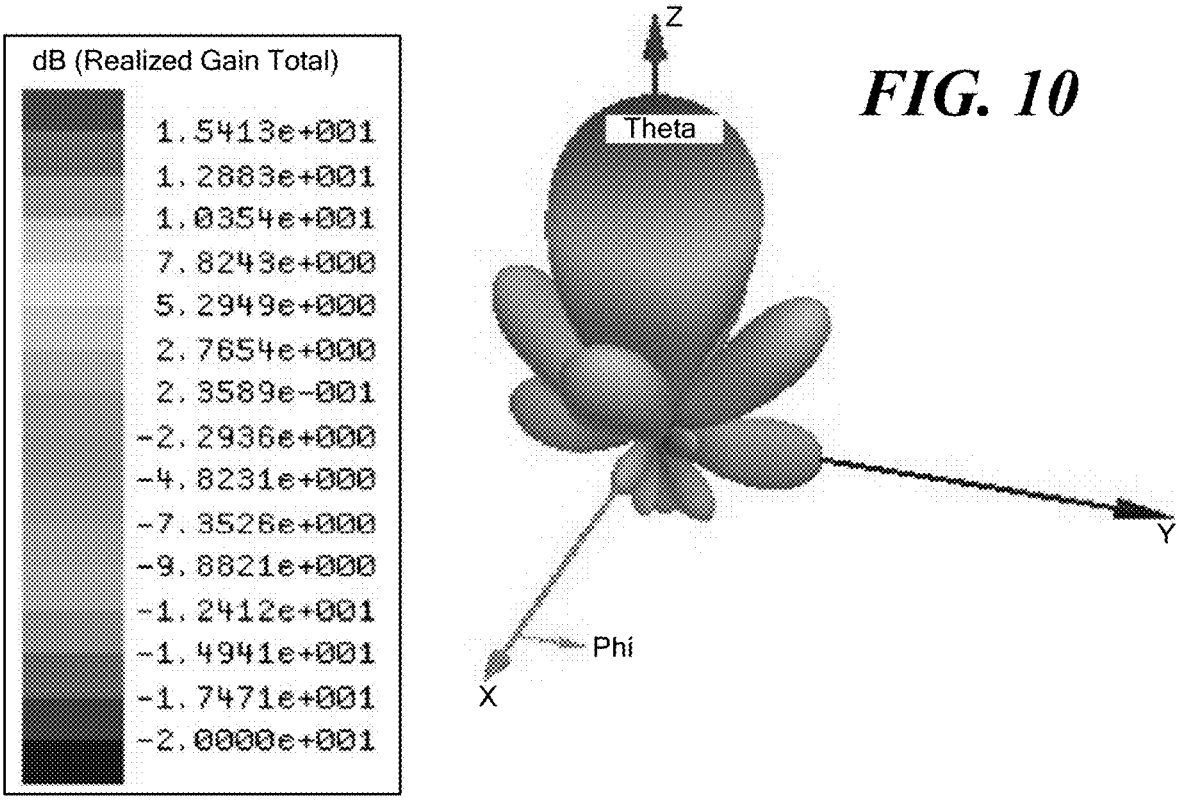
Figure 11:
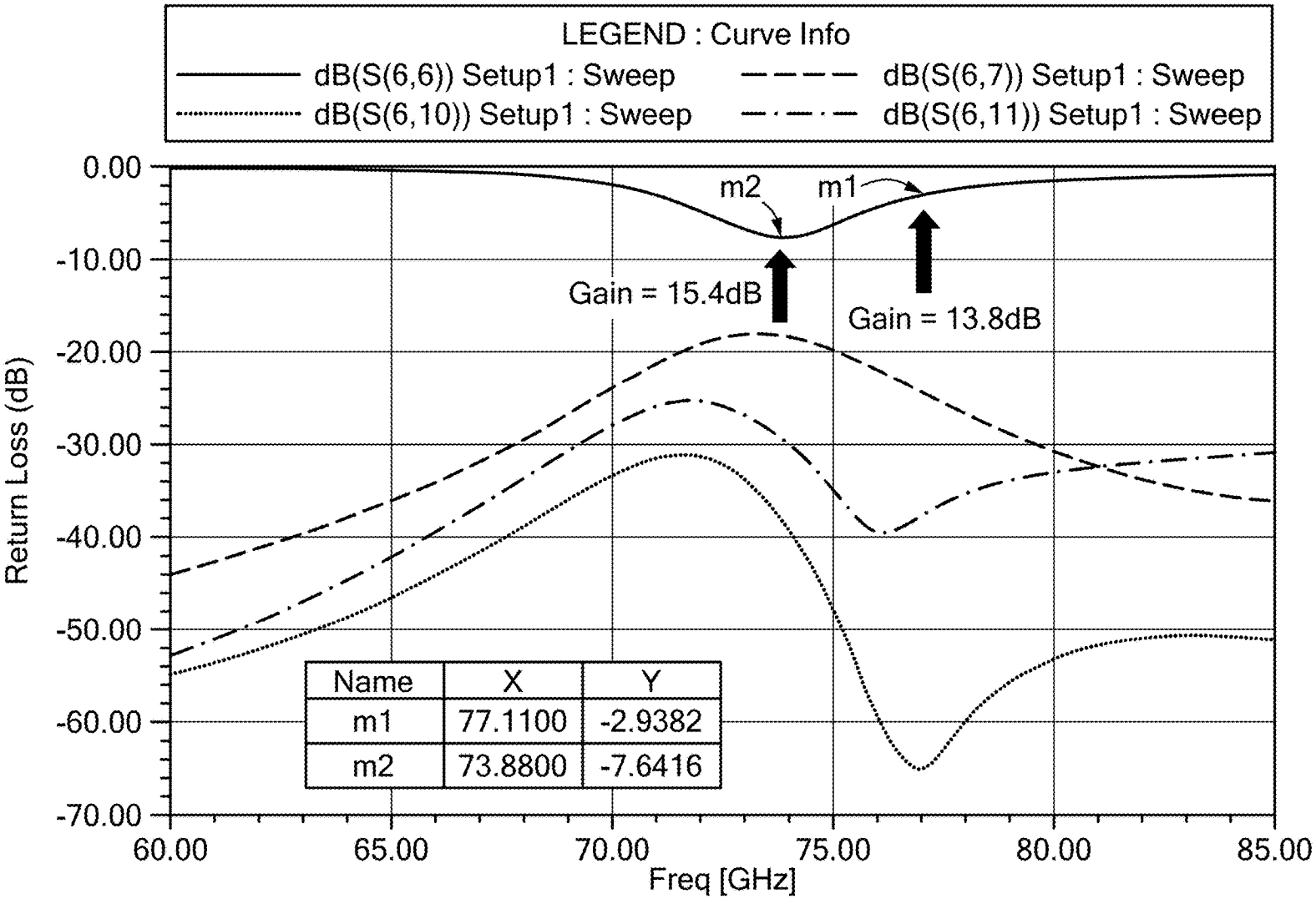
FIG. 11 depicts simulation data in comparison to FIGS. 5 and 9.
Figure 12:
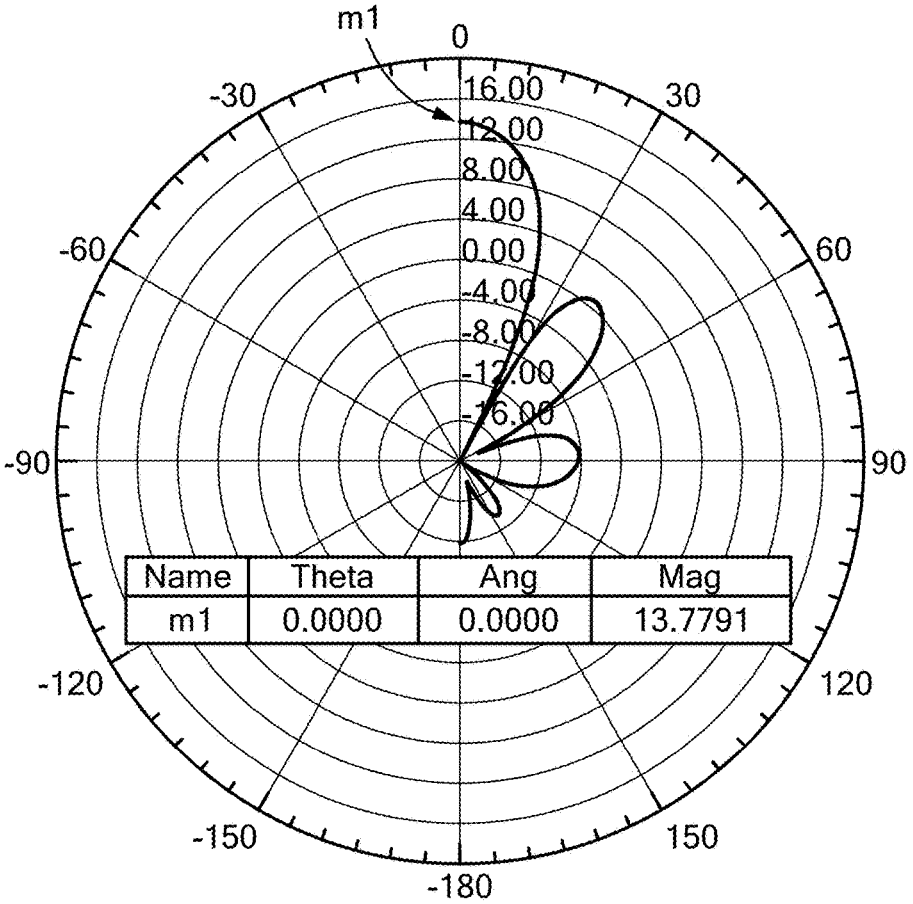
FIG. 12 depicts simulation data in comparison to FIGS. 6 and 10.
Figure 12:
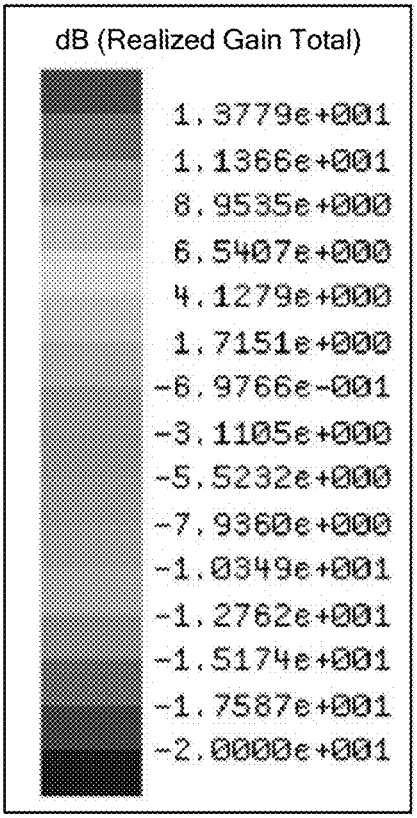
Figure 12:
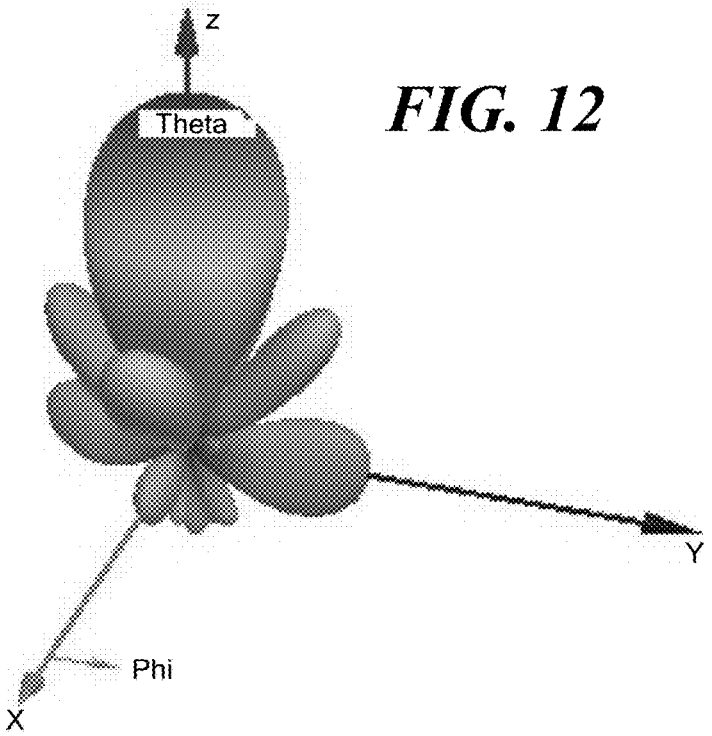
Figure 13A:
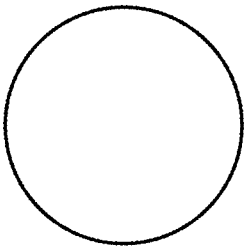
FIGS. 13A, 13B, 13C, 13D and 13E depict alternative axial cross section shapes of a dielectric resonator, in accordance with an embodiment.
Figure 13B:
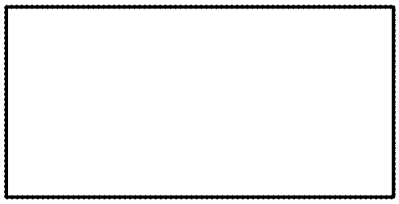
Figure 13C:
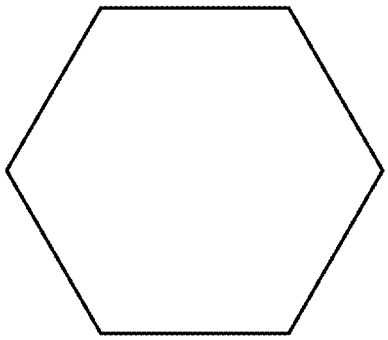
Figure 13D:
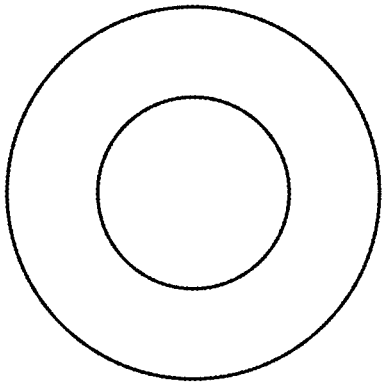
Figure 13E:
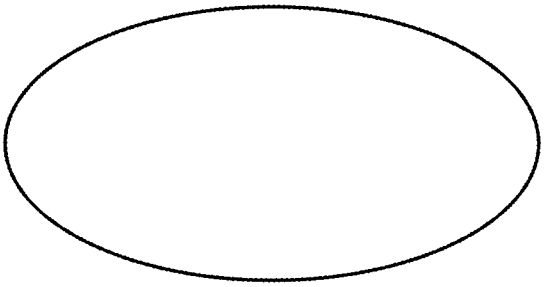
Figure 14A:
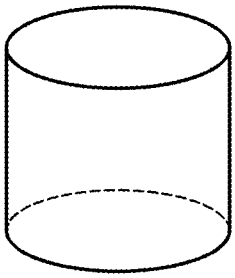
FIGS. 14A, 14B, 14C, 14D, 14E, 14F and 14G depict alternative three-dimensional shapes of a dielectric resonator, in accordance with an embodiment.
Figure 14B:
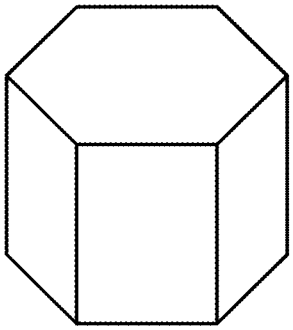
Figure 14C:
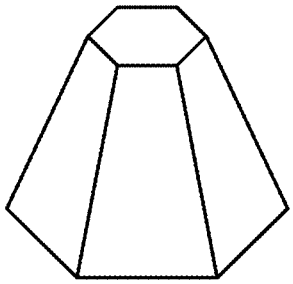
Figure 14D:
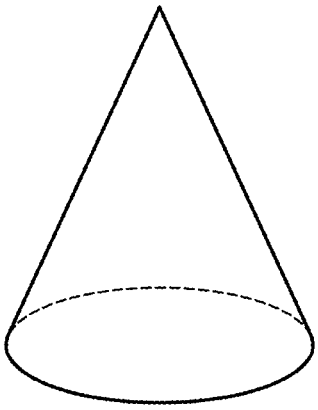
Figure 14E:
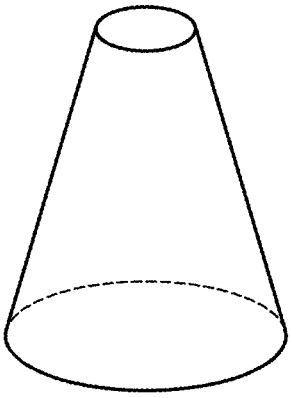
Figure 14F:
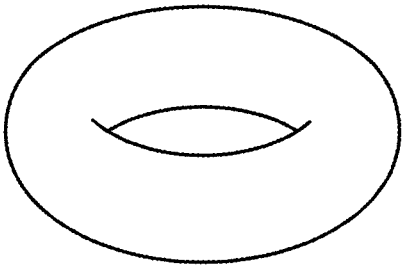
Figure 14G:
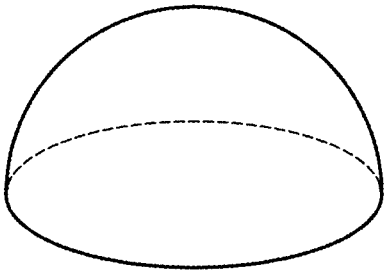

Reference is now made to FIGS. 9-12, which provide comparative data relating to non-offset, or only slightly offset, signal feeds corresponding to an offset of 0.15 mm instead of 0.3 mm (presented above). As seen in FIGS. 9 and 10, the return loss S11 in dB vs. Frequency in GHz for a 4×4 array degrades to −7.6 dB at about 74 GHz in FIG. 9, and the associated gain degrades to around 15 dB in FIG. 10, a loss of 2 dB over the embodiment of FIG. 6. This comparison shows that the structure and operating mode disclosed herein is improved with "edge" signal feeding, or "near-edge" signal feeding. As depicted in FIG. 9, the "Legend: Curve Info" box relates the illustrated return loss data curves S(6, 6), S(6, 7), S(6, 10), and S(6, 11) to the corresponding resonator locations 6, 7, 10, and 11, depicted in FIG. 1A. FIGS. 11 and 12 illustrate another result of shifting the signal feed offset to zero or near zero, 0.15 mm in this case. Here, the resonant frequency is seen to shift from 77 GHz to 74 GHz, with the resulting gain at 77 GHz being only 13.8 dB, a loss of 3 dB over the embodiment of FIG. 6. As depicted in FIG. 11, the "Legend: Curve Info" box relates the illustrated return loss in dB vs. Frequency in GHz data curves S(6, 6), S(6, 7), S(6, 10), and S(6, 11) to the corresponding resonator locations 6, 7, 10, and 11, depicted in FIG. 1A.

Figure 15A:
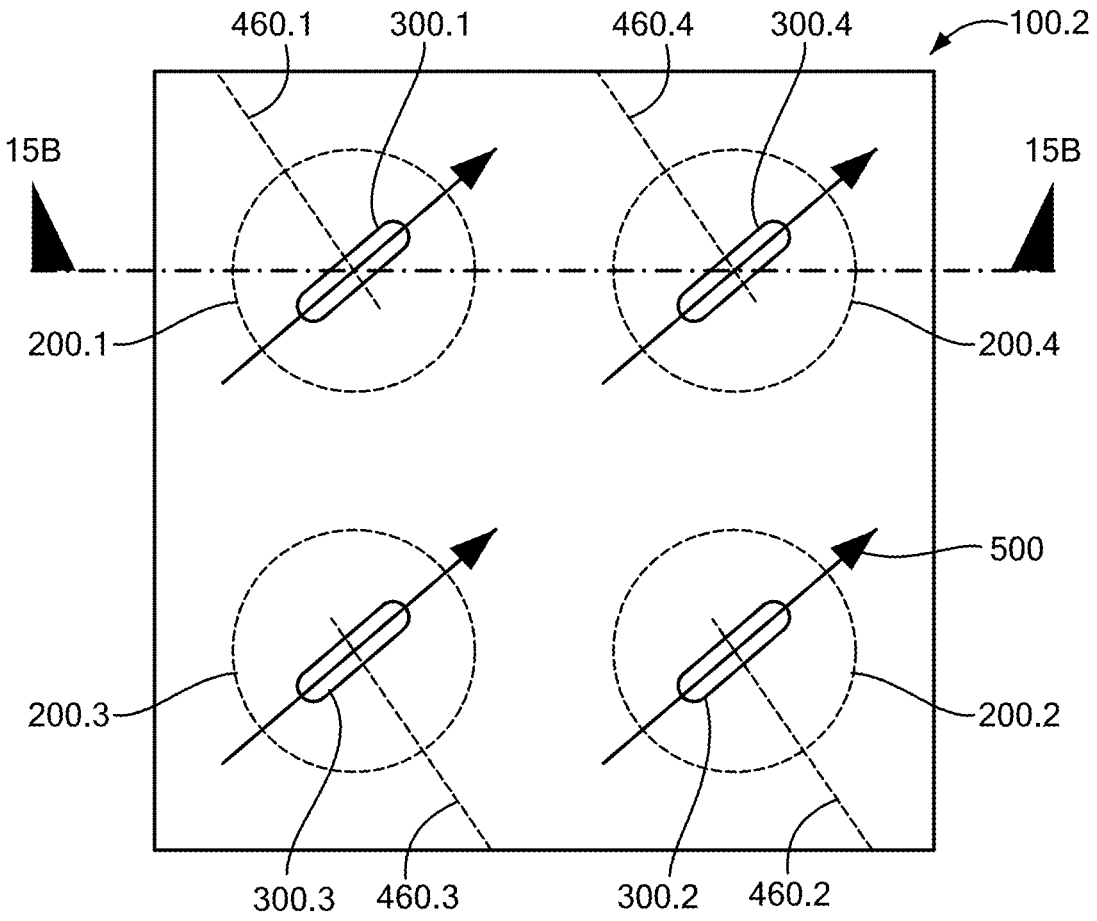
FIG. 15A depicts an alternative array apparatus to that of FIG. 3B showing the orientation of slotted apertures and the resulting skewed magnetic dipoles, in accordance with an embodiment.

Reference is now made to FIG. 15A, which depicts a plan view of an array apparatus 100.2 similar to that of array apparatus 100.1 depicted in FIG. 3B, but comprising slotted apertures 300.1, 300.2, 300.3, 300.4 as part of the individual signal feed structures, as opposed to a coaxial cable signal line 300 in FIG. 1B. Similar to the arrangement described herein above with respect to array apparatus 100.1, the signal feeds via the slotted apertures 300.1, 300.2, 300.3, 300.4 of array apparatus 100.2 are arranged relative to each other such that each pair of closest adjacent ones of a corresponding resulting magnetic dipole 500, both horizontally and vertically, are oriented parallel with each other but not in linear alignment with each other. It will also be noted that each respective signal feed, with reference to the slotted apertures 300.1, 300.2, 300.3, 300.4, has a lengthwise feed direction that is disposed in linear alignment with corresponding ones of the resulting magnetic dipole vectors 500. It will further be noted that each pair of closest adjacent ones of the slotted aperture 300.1, 300.2, 300.3, 300.4 associated with corresponding ones of the plurality of dielectric resonators 200.1, 200.1, 200.3, 200.4 are lengthwise oriented parallel with each other but not in linear alignment with each other.

Figure 15B:
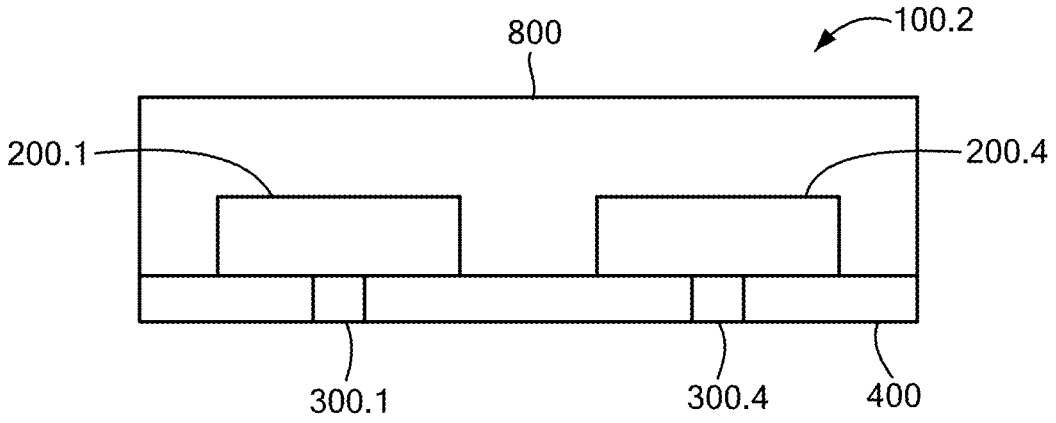
FIG. 15B depicts a side view section cut through section cut line 15B-15B depicted in FIG. 15A, in accordance with an embodiment.
Figure 16:
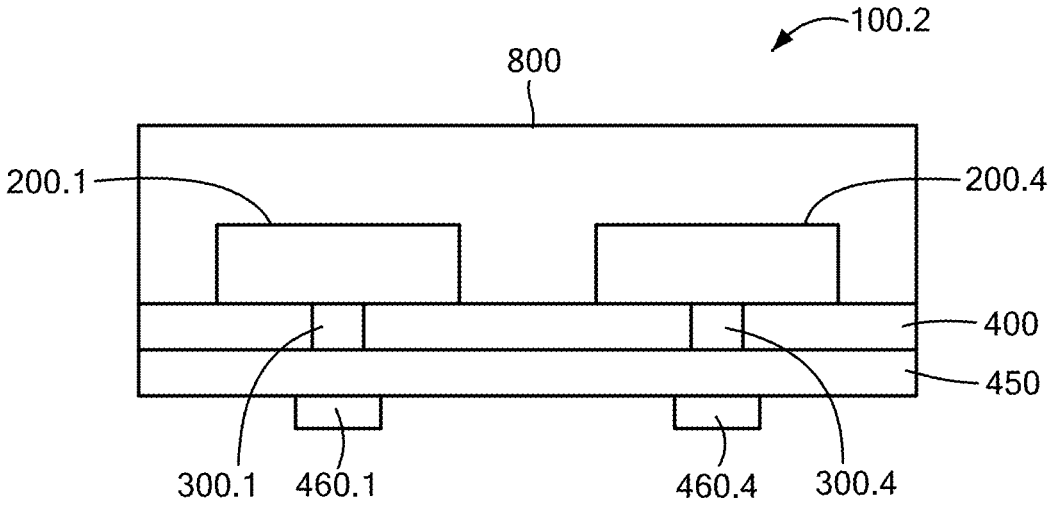
FIG. 16 depicts a similar view as that of FIG. 15B but also depicting a dielectric layer and a microstrip, in accordance with an embodiment.

FIG. 15B depicts a cross section side view through section cut line 15B-15B depicted in FIG. 15A. Similar to the array apparatus 100 depicted in FIG. 1B, array apparatus 100.2 includes dielectric resonators (200.1 and 200.4 depicted in FIG. 15B) disposed on and in electrical communication with a ground layer 400, with slotted apertures (300.1 and 300.4 depicted in FIG. 15B) through the ground layer 400, and an encapsulating layer 800 disposed over the plurality of resonators, as described herein above with reference to FIG. 1B. FIG. 16 depicts a similar view as that of FIG. 15B, but with the inclusion of a dielectric layer 450 below the ground layer 400, and microstrip feeds (460.1 and 460.4 depicted in FIG. 16) strategically arranged relative to the corresponding slotted apertures (300.1 and 300.4 depicted in FIG. 16). Reference back to FIG. 15A will show the orientation of microstrip feeds 460.1, 460.2, 460.3, 460.4 relative to each slotted aperture 300.1, 300.2, 300.3, 300.4, where it can be seen that the microstrip feeds are oriented perpendicular to the lengthwise direction of the corresponding slotted apertures.

Figure 17A:
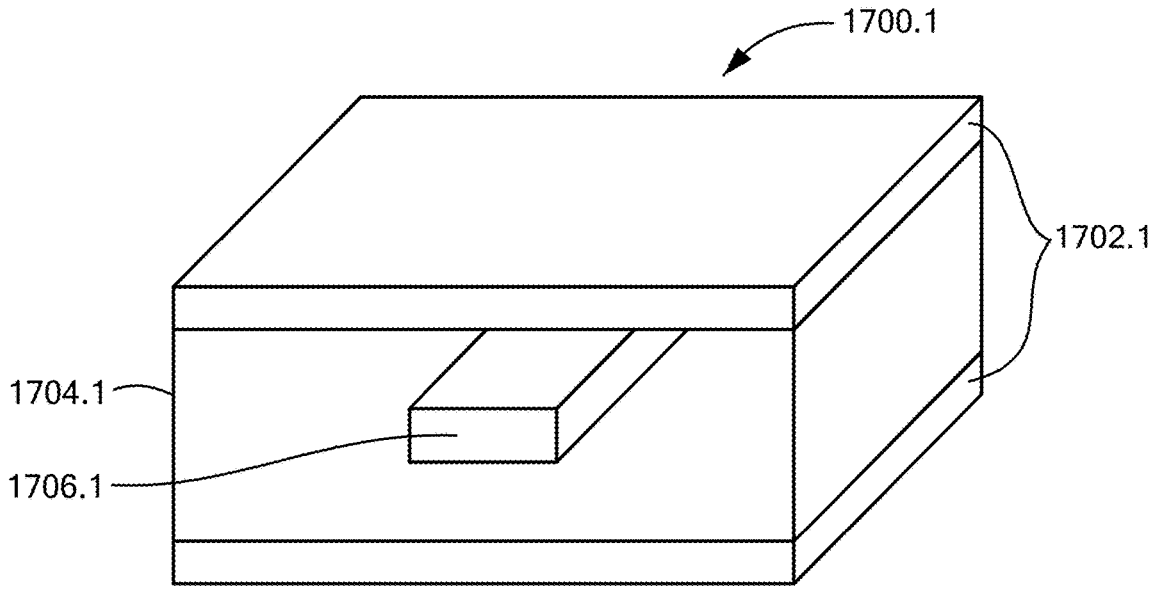
FIGS. 17A, 17B, 17C and 17D depict alternative signal feeds to those depicted in FIGS. 3B, 15A and 16, in accordance with an embodiment.
Figure 17B:
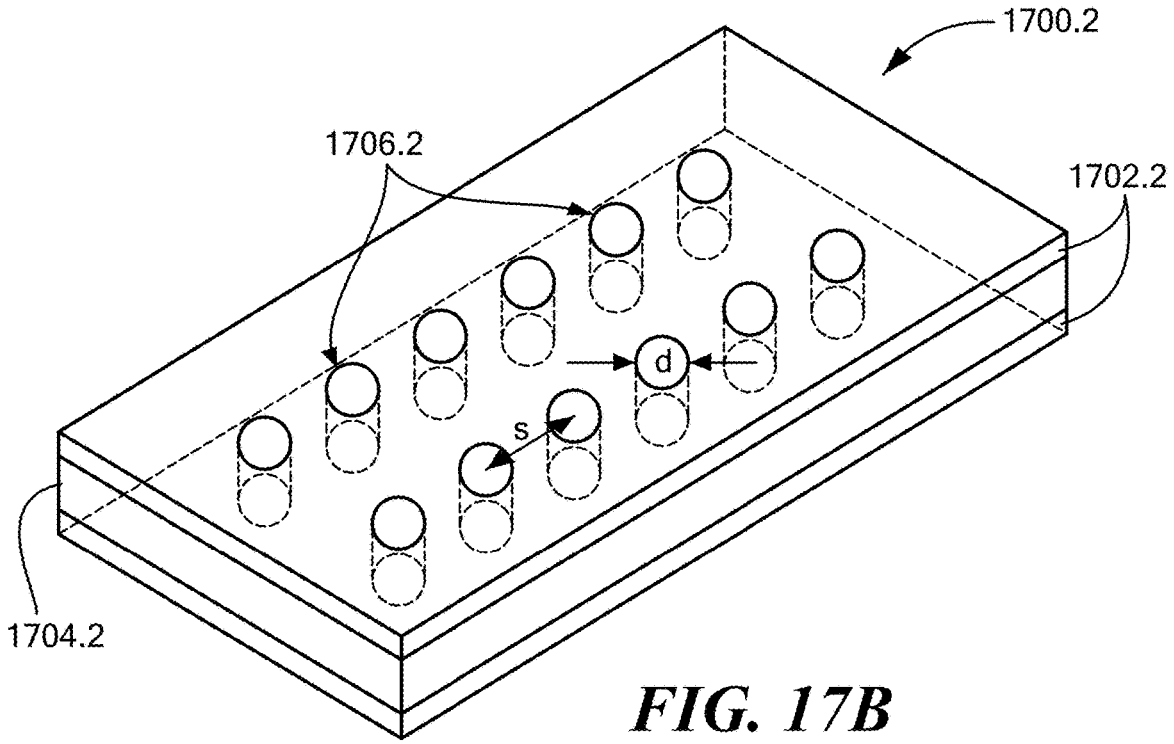
Figure 17C:
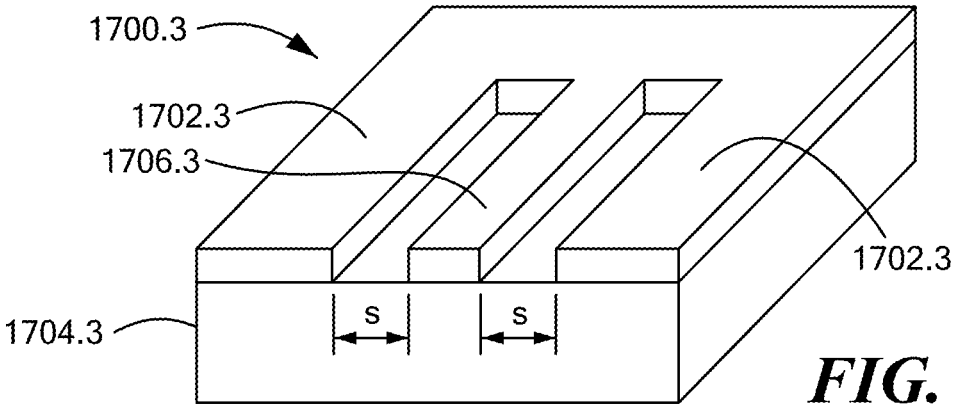
Figure 17D:
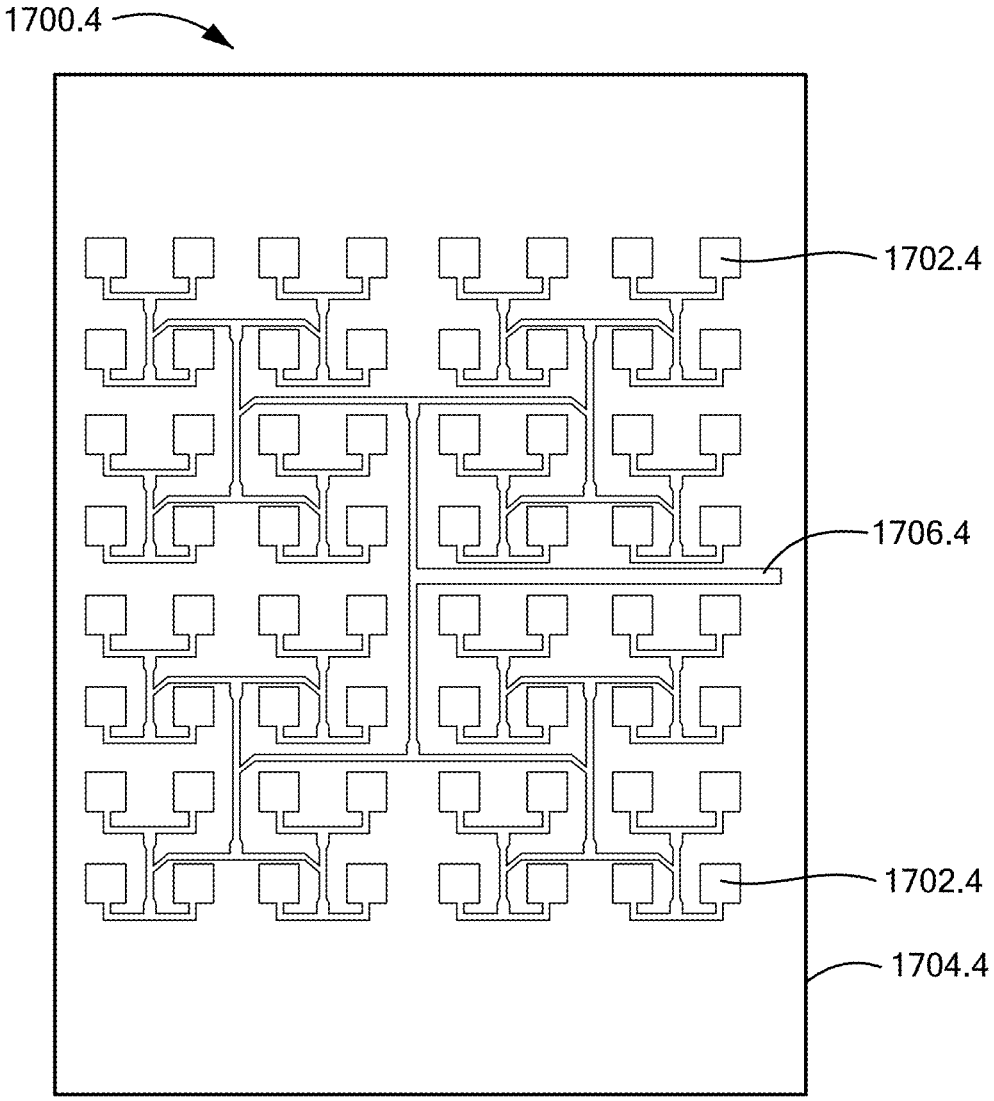

As best understood by applicant, the embodiment depicted in FIG. 15A will perform similarly to the embodiment depicted in FIG. 3B where only the signal feeds have been changed from a coaxial cable feed structure to a microstrip with slotted aperture feed structure, as such electromagnetic feed structures are considered to be reasonably interchangeable. Similarly, applicant further considers other feed structures to be interchangeable with the aforementioned coaxial cable and microstrip-slotted aperture feed structure, such as a stripline or feeder strip 1700.1 (FIG. 17A), a substrate integrated waveguide (SIW) 1700.2 (FIG. 17B), a coplanar waveguide (CPW) 1700.3 (FIG. 17C), or a corporate-type feed 1700.4 (FIG. 17D). In FIG. 17A, the stripline or feeder strip 1700.1 includes two ground plates 1702.1 with a dielectric 1704.1 sandwiched therebetween, and with a signal line 1706.1 embedded with the dielectric 1704.1. In FIG. 17B, the SIW 1700.2 includes two ground plates 1702.2 with a dielectric 1704.2 sandwiched therebetween, and with conductive vias 1706.2 embedded with the dielectric 1704.2 and arranged in electrically contact with and between the two ground plates 1702.2 to establish and electromagnetic waveguide between the vias 1706.2 in the dielectric 1704.2. The electrically conductive vias 1706.2 have a diameter "d" and a sideways center-to-center spacing "s" in accordance with a desired operating electromagnetic wavelength. In FIG. 17C, the CPW 1700.3 has electrical return paths 1702.3 with a centrally disposed signal path 1706.3 sideways spaced apart from the return paths 1702.3 by a distance "s", with the return paths 1702.3 and the signal path 1706.6 being disposed on a dielectric 1704.3. In FIG. 17D, the corporate-type feed 1700.4 includes a common signal feed 1706.4 electrically connected to a plurality of distributed signal feeds 1702.4, all of which is disposed on a dielectric 1704.4.

Dielectric Materials

The dielectric materials for use in the resonators 200 and the encapsulating layer 800 are selected to provide the desired electro-magnetic properties for a purpose disclosed herein, and generally comprise a thermoplastic or thermosetting polymer matrix and a dielectric filler, where the dielectric filler for the resonators 200 has a relatively high dielectric constant, such as equal to or greater than 10, preferably equal to or greater than 15, or more preferably equal to or greater than 20, and the dielectric filler for the encapsulating layer 800 has a relatively low dielectric constant, such as equal to or less than 10, preferably less than 10, or more preferably equal to or less than 5.

The dielectric materials can comprise, based on the volume of the dielectric structure, 30 to 99 volume percent (vol %) of a polymer matrix, and 0 to 70 vol %, specifically, 1 to 70 vol %, more specifically, 5 to 50 vol % of a filler.

The polymer and the filler for the resonators 200 are selected to provide a dielectric material having a dielectric constant consistent with the above-noted values and a loss tangent dissipation factor of equal to or less than 0.003, specifically, equal to or less than 0.002 at 10 gigaHertz (GHz). The dissipation factor can be measured by the IPC-TM-650 X-band strip line method or by the Split Resonator method.

The polymer and the filler for the encapsulating layer 800 are selected to provide a dielectric material having a dielectric constant consistent with the above-noted values and a loss tangent dissipation factor of equal to or less than 0.006, specifically, equal to or less than 0.0035 at 10 gigaHertz (GHz). The dissipation factor can be measured by the IPC-TM-650 X-band strip line method or by the Split Resonator method.

The dielectric materials can be either thermosetting or thermoplastic. The polymer can comprise 1,2-polybutadiene (PBD), polyisoprene, polybutadiene-polyisoprene copolymers, polyetherimide (PEI), fluoropolymers such as polytetrafluoroethylene (PTFE), polyimide, polyetheretherketone (PEEK), polyamidimide, polyethylene terephthalate (PET), polyethylene naphthalate, polycyclohexylene terephthalate, polybutadiene-polyisoprene copolymers, polyphenylene ethers, those based on allylated polyphenylene ethers, or a combination comprising at least one of the foregoing. Combinations of low polarity s with higher polarity s can also be used, non-limiting examples including epoxy and poly(phenylene ether), epoxy and poly(ether imide), cyanate ester and poly(phenylene ether), and 1,2-polybutadiene and polyethylene. As used herein, the solo parameter "s" is representative of exemplary compounds that are broadly classified as "polybutadienes" by their manufacturers, for example, Nippon Soda Co., Tokyo, Japan, and Cray Valley Hydrocarbon Specialty Chemicals, Exton, Pa.

Fluoropolymers include fluorinated homopolymers, e.g., PTFE and polychlorotrifluoroethylene (PCTFE), and fluorinated copolymers, e.g. copolymers of tetrafluoroethylene or chlorotrifluoroethylene with a monomer such as hexafluoropropylene and perfluoroalkylvinylethers vinylidene fluoride, vinyl fluoride, ethylene, or a combination comprising at least one of the foregoing, The fluoropolymer can comprise a combination of different at least one these fluoropolymers.

The polymer matrix can comprise thermosetting polybutadiene and/or polyisoprene. As used herein, the term "thermosetting polybutadiene and/or polyisoprene" includes homopolymers and copolymers comprising units derived from butadiene, isoprene, or mixtures thereof. Units derived from other copolymerizable monomers can also be present in the polymer, for example, in the form of grafts. Exemplary copolymerizable monomers include, but are not limited to, vinylaromatic monomers, for example substituted and unsubstituted monovinylaromatic monomers such as styrene, 3-methylstyrene, 3,5-diethylstyrene, 4-n-propylstyrene, alpha-methylstyrene, alpha-methyl vinyltoluene, para-hydroxystyrene, para-methoxystyrene, alpha-chlorostyrene, alpha-bromostyrene, dichlorostyrene, dibromostyrene, tetrachlorostyrene, and the like; and substituted and unsubstituted divinylaromatic monomers such as divinylbenzene, divinyltoluene, and the like. Combinations comprising at least one of the foregoing copolymerizable monomers can also be used. Exemplary thermosetting polybutadiene and/or polyisoprene s include, but are not limited to, butadiene homopolymers, isoprene homopolymers, butadiene-vinylaromatic copolymers such as butadiene-styrene, isoprene-vinylaromatic copolymers such as isoprene-styrene copolymers, and the like.

The thermosetting polybutadiene and/or polyisoprenes can also be modified. For example, the polymers can be hydroxyl-terminated, methacrylate-terminated, carboxylate-terminated, s or the like. Post-reacted polymers can be used, such as epoxy-, maleic anhydride-, or urethane-modified polymers of butadiene or isoprene polymers. The polymers can also be crosslinked, for example by divinylaromatic compounds such as divinyl benzene, e.g., a polybutadiene-styrene crosslinked with divinyl benzene. Mixtures of s can also be used, for example, a mixture of a polybutadiene homopolymer and a poly(butadiene-isoprene) copolymer. Combinations comprising a syndiotactic polybutadiene can also be useful.

The thermosetting polybutadiene and/or polyisoprene can be liquid or solid at room temperature. The liquid polymer can have a number average molecular weight (Mn) of greater than or equal to 5,000 g/mol. The liquid polymer can have an Mn of less than 5,000 g/mol, specifically, 1,000 to 3,000 g/mol. Thermosetting polybutadiene and/or polyisoprenes having at least 90 wt % 1,2 addition, which can exhibit greater crosslink density upon cure due to the large number of pendent vinyl groups available for crosslinking.

The polybutadiene and/or polyisoprene can be present in the polymer composition in an amount of up to 100 wt %, specifically, up to 75 wt % with respect to the total polymer matrix composition, more specifically, 10 to 70 wt %, even more specifically, 20 to 60 or 70 wt %, based on the total polymer matrix composition.

Other polymers that can co-cure with the thermosetting polybutadiene and/or polyisoprene s can be added for specific property or processing modifications. For example, in order to improve the stability of the dielectric strength and mechanical properties of the electrical substrate material over time, a lower molecular weight ethylene-propylene elastomer can be used in the systems. An ethylene-propylene elastomer as used herein is a copolymer, terpolymer, or other polymer comprising primarily ethylene and propylene. Ethylene-propylene elastomers can be further classified as EPM copolymers (i.e., copolymers of ethylene and propylene monomers) or EPDM terpolymers (i.e., terpolymers of ethylene, propylene, and diene monomers). Ethylene-propylene-diene terpolymer rubbers, in particular, have saturated main chains, with unsaturation available off the main chain for facile cross-linking. Liquid ethylene-propylene-diene terpolymer rubbers, in which the diene is dicyclopentadiene, can be used.

The molecular weights of the ethylene-propylene rubbers can be less than 10,000 g/mol viscosity average molecular weight (Mv). The ethylene-propylene rubber can include an ethylene-propylene rubber having an Mv of 7,200 g/mol, which is available from Lion Copolymer, Baton Rouge, La., under the trade name TRILENE™ CP80; a liquid ethylene-propylene-dicyclopentadiene terpolymer rubbers having an Mv of 7,000 g/mol, which is available from Lion Copolymer under the trade name of TRILENE™ 65; and a liquid ethylene-propylene-ethylidene norbornene terpolymer having an Mv of 7,500 g/mol, which is available from Lion Copolymer under the name TRILENE™ 67.

The ethylene-propylene rubber can be present in an amount effective to maintain the stability of the properties of the substrate material over time, in particular the dielectric strength and mechanical properties. Typically, such amounts are up to 20 wt % with respect to the total weight of the polymer matrix composition, specifically, 4 to 20 wt %, more specifically, 6 to 12 wt %.

Another type of co-curable polymer is an unsaturated polybutadiene- or polyisoprene-containing elastomer. This component can be a random or block copolymer of primarily 1,3-addition butadiene or isoprene with an ethylenically unsaturated monomer, for example, a vinylaromatic compound such as styrene or alpha-methyl styrene, an acrylate or methacrylate such a methyl methacrylate, or acrylonitrile. The elastomer can be a solid, thermoplastic elastomer comprising a linear or graft-type block copolymer having a polybutadiene or polyisoprene block and a thermoplastic block that can be derived from a monovinylaromatic monomer such as styrene or alpha-methyl styrene. Block copolymers of this type include styrene-butadiene-styrene triblock copolymers, for example, those available from Dexco Polymers, Houston, Tex. under the trade name VECTOR 8508M™, from Enichem Elastomers America, Houston, Tex. under the trade name SOL-T-6302™, and those from Dynasol Elastomers under the trade name CALPRENE™ 401; and styrene-butadiene diblock copolymers and mixed triblock and diblock copolymers containing styrene and butadiene, for example, those available from Kraton Polymers (Houston, Tex.) under the trade name KRATON D1118. KRATON D1118 is a mixed diblock/triblock styrene and butadiene containing copolymer that contains 33 wt % styrene.

The optional polybutadiene- or polyisoprene-containing elastomer can further comprise a second block copolymer similar to that described above, except that the polybutadiene or polyisoprene block is hydrogenated, thereby forming a polyethylene block (in the case of polybutadiene) or an ethylene-propylene copolymer block (in the case of polyisoprene). When used in conjunction with the above-described copolymer, materials with greater toughness can be produced. An exemplary second block copolymer of this type is KRATON GX1855 (commercially available from Kraton Polymers, which is believed to be a mixture of a styrene-high 1,2-butadiene-styrene block copolymer and a styrene-(ethylene-propylene)-styrene block copolymer.

The unsaturated polybutadiene- or polyisoprene-containing elastomer component can be present in the polymer matrix composition in an amount of 2 to 60 wt % with respect to the total weight of the polymer matrix composition, specifically, 5 to 50 wt %, more specifically, 10 to 40 or 50 wt %.

Still other co-curable polymers that can be added for specific property or processing modifications include, but are not limited to, homopolymers or copolymers of ethylene such as polyethylene and ethylene oxide copolymers; natural rubber; norbornene polymers such as polydicyclopentadiene; hydrogenated styrene-isoprene-styrene copolymers and butadiene-acrylonitrile copolymers; unsaturated polyesters; and the like. Levels of these copolymers are generally less than 50 wt % of the total polymer in the polymer matrix composition.

Free radical-curable monomers can also be added for specific property or processing modifications, for example to increase the crosslink density of the system after cure. Exemplary monomers that can be suitable crosslinking agents include, for example, di, tri-, or higher ethylenically unsaturated monomers such as divinyl benzene, triallyl cyanurate, diallyl phthalate, and multifunctional acrylate monomers (e.g., SARTOMER™ polymers available from Sartomer USA, Newtown Square, Pa.), or combinations thereof, all of which are commercially available. The crosslinking agent, when used, can be present in the polymer matrix composition in an amount of up to 20 wt %, specifically, 1 to 15 wt %, based on the total weight of the total polymer in the polymer matrix composition.

A curing agent can be added to the polymer matrix composition to accelerate the curing reaction of polyenes having olefinic reactive sites. Curing agents can comprise organic peroxides, for example, dicumyl peroxide, t-butyl perbenzoate, 2,5-dimethyl-2,5-di(t-butyl peroxy)hexane, α,α-di-bis(t-butyl peroxy)diisopropylbenzene, 2,5-dimethyl-2,5-di(t-butyl peroxy) hexyne-3, or a combination comprising at least one of the foregoing. Carbon-carbon initiators, for example, 2,3-dimethyl-2,3 diphenylbutane can be used. Curing agents or initiators can be used alone or in combination. The amount of curing agent can be 1.5 to 10 wt % based on the total weight of the polymer in the polymer matrix composition.

In some embodiments, the polybutadiene or polyisoprene polymer is carboxy-functionalized. Functionalization can be accomplished using a polyfunctional compound having in the molecule both (i) a carbon-carbon double bond or a carbon-carbon triple bond, and (ii) at least one of a carboxy group, including a carboxylic acid, anhydride, amide, ester, or acid halide. A specific carboxy group is a carboxylic acid or ester. Examples of polyfunctional compounds that can provide a carboxylic acid functional group include maleic acid, maleic anhydride, fumaric acid, and citric acid. In particular, polybutadienes adducted with maleic anhydride can be used in the thermosetting composition. Suitable maleinized polybutadiene polymers are commercially available, for example from Cray Valley under the trade names RICON 130MA8, RICON 130MA13, RICON 130MA20, RICON 131MA5, RICON 131MA10, RICON 131MA17, RICON 131MA20, and RICON 156MA17. Suitable maleinized polybutadiene-styrene copolymers are commercially available, for example, from Sartomer under the trade names RICON 184MA6. RICON 184MA6 is a butadiene-styrene copolymer adducted with maleic anhydride having styrene content of 17 to 27 wt % and Mn of 9,900 g/mol.

The relative amounts of the various polymers in the polymer matrix composition, for example, the polybutadiene or polyisoprene polymer and other polymers, can depend on the particular conductive metal layer used, the desired properties of the circuit materials and copper clad laminates, and like considerations. For example, use of a poly(arylene ether) can provide increased bond strength to the conductive metal layer, for example, copper. Use of a polybutadiene or polyisoprene polymer can increase high temperature resistance of the laminates, for example, when these polymers are carboxy-functionalized. Use of an elastomeric block copolymer can function to compatibilize the components of the polymer matrix material. Determination of the appropriate quantities of each component can be done without undue experimentation, depending on the desired properties for a particular application.

At least one of the dielectric materials can further include a particulate dielectric filler selected to adjust the dielectric constant, dissipation factor, coefficient of thermal expansion, and other properties of the dielectric layer. The dielectric filler can comprise, for example, titanium dioxide $TiO_2$ (rutile and anatase), barium titanate, strontium titanate, silica (including fused amorphous silica), corundum, wollastonite, $Ba_2Ti_9O_{20}$, solid glass spheres, synthetic glass or ceramic hollow spheres, quartz, boron nitride, aluminum nitride, silicon carbide, beryllia, alumina, alumina trihydrate, magnesia, mica, talcs, nanoclays, magnesium hydroxide, or a combination comprising at least one of the foregoing. A single filler, or a combination of fillers, can be used to provide a desired balance of properties.

Optionally, the fillers can be surface treated with a silicon-containing coating, for example, an organofunctional alkoxy silane coupling agent. A zirconate or titanate coupling agent can be used. Such coupling agents can improve the dispersion of the filler in the polymeric matrix and reduce water absorption of the finished composite circuit substrate. The filler component can comprise 70 to 30 vol % of fused amorphous silica based on the weight of the filler.

The dielectric materials can also optionally contain a flame retardant useful for making the layer resistant to flame. These flame retardant can be halogenated or unhalogenated. The flame retardant can be present in the dielectric material in an amount of 0 to 30 vol % based on the volume of the dielectric material.

In an embodiment, the flame retardant is inorganic and is present in the form of particles. An exemplary inorganic flame retardant is a metal hydrate, having, for example, a volume average particle diameter of 1 nm to 500 nm, preferably 1 to 200 nm, or 5 to 200 nm, or 10 to 200 nm; alternatively the volume average particle diameter is 500 nm to 15 micrometer, for example 1 to 5 micrometer. The metal hydrate is a hydrate of a metal such as Mg, Ca, Al, Fe, Zn, Ba, Cu, Ni, or a combination comprising at least one of the foregoing. Hydrates of Mg, Al, or Ca are particularly preferred, for example aluminum hydroxide, magnesium hydroxide, calcium hydroxide, iron hydroxide, zinc hydroxide, copper hydroxide and nickel hydroxide; and hydrates of calcium aluminate, gypsum dihydrate, zinc borate and barium metaborate. Composites of these hydrates can be used, for example a hydrate containing Mg and one or more of Ca, Al, Fe, Zn, Ba, Cu and Ni. A preferred composite metal hydrate has the formula $MgMx.(OH)_y$ wherein M is Ca, Al, Fe, Zn, Ba, Cu or Ni, x is 0.1 to 10, and y is from 2 to 32. The flame retardant particles can be coated or otherwise treated to improve dispersion and other properties.

Organic flame retardants can be used, alternatively or in addition to the inorganic flame retardants. Examples of inorganic flame retardants include melamine cyanurate, fine particle size melamine polyphosphate, various other phosphorus-containing compounds such as aromatic phosphinates, diphosphinates, phosphonates, and phosphates, certain polysilsesquioxanes, siloxanes, and halogenated compounds such as hexachloroendomethylenetetrahydrophthalic acid (HET acid), tetrabromophthalic acid and dibromoneopentyl glycol A flame retardant (such as a bromine-containing flame retardant) can be present in an amount of 20 phr (parts per hundred parts of resin) to 60 phr, specifically, 30 to 45 phr. Examples of brominated flame retardants include Saytex BT93 W (ethylene bistetrabromophthalimide), Saytex 120 (tetradecabromodiphenoxy benzene), and Saytex 102 (decabromodiphenyl oxide). The flame retardant can be used in combination with a synergist, for example a halogenated flame retardant can be used in combination with a synergists such as antimony trioxide, and a phosphorus-containing flame retardant can be used in combination with a nitrogen-containing compound such as melamine.

Useful conductive materials for the formation of the conductive ground layer 400 include, for example, stainless steel, copper, gold, silver, aluminum, zinc, tin, lead, transition metals, and alloys comprising at least one of the foregoing. There are no particular limitations regarding the thickness of the conductive layer, nor are there any limitations as to the shape, size, or texture of the surface of the conductive layer. When two or more conductive layers are present, the thickness of the two layers can be the same or different. In an exemplary embodiment, the conductive layer is a copper layer. The various materials and articles used herein can be formed by methods generally known in the art.

The encapsulating layer 800 can be formed by casting directly onto the resonators 200 and ground layer 400, or an encapsulating layer 800 can be produced that can be laminated onto the resonators 200 and ground layer 400. The encapsulating layer 800 can be produced based on the polymer selected. For example, where the polymer comprises a fluoropolymer such as PTFE, the polymer can be mixed with a first carrier liquid. The mixture can comprise a dispersion of polymeric particles in the first carrier liquid, i.e. an emulsion, of liquid droplets of the polymer or of a monomeric or oligomeric precursor of the polymer in the first carrier liquid, or a solution of the polymer in the first carrier liquid. If the polymer is liquid, then no first carrier liquid may be necessary.

The choice of the first carrier liquid, if present, can be based on the particular polymeric and the form in which the polymeric is to be introduced to the encapsulating layer 800. If it is desired to introduce the polymeric as a solution, a solvent for the particular polymer is chosen as the carrier liquid, e.g., N-methyl pyrrolidone (NMP) would be a suitable carrier liquid for a solution of a polyimide. If it is desired to introduce the polymer as a dispersion, then the carrier liquid can comprise a liquid in which the is not soluble, e.g., water would be a suitable carrier liquid for a dispersion of PTFE particles and would be a suitable carrier liquid for an emulsion of polyamic acid or an emulsion of butadiene monomer.

The dielectric filler component can optionally be dispersed in a second carrier liquid, or mixed with the first carrier liquid (or liquid polymer where no first carrier is used). The second carrier liquid can be the same liquid or can be a liquid other than the first carrier liquid that is miscible with the first carrier liquid. For example, if the first carrier liquid is water, the second carrier liquid can comprise water or an alcohol. The second carrier liquid can comprise water.

The filler dispersion can comprise a surfactant in an amount effective to modify the surface tension of the second carrier liquid to enable the second carrier liquid to wet the filler. Exemplary surfactant compounds include ionic surfactants and nonionic surfactants. TRITON X-100™, has been found to be an exemplary surfactant for use in aqueous filler dispersions. The filler dispersion can comprise 10 to 70 vol % of filler and 0.1 to 10 vol % of surfactant, with the remainder comprising the second carrier liquid.

The combination of the polymer and first carrier liquid and the filler dispersion in the second carrier liquid can be combined to form a casting mixture. In an embodiment, the casting mixture comprises 10 to 60 vol % of the combined polymer and filler and 40 to 90 vol % combined first and second carrier liquids. The relative amounts of the polymer and the filler component in the casting mixture can be selected to provide the desired amounts in the final composition as described below.

The viscosity of the casting mixture can be adjusted by the addition of a viscosity modifier, selected on the basis of its compatibility in a particular carrier liquid or mixture of carrier liquids, to retard separation, i.e. sedimentation or flotation, of the hollow sphere filler from the dielectric composite material and to provide a dielectric composite material having a viscosity compatible with conventional laminating equipment. Exemplary viscosity modifiers suitable for use in aqueous casting mixtures include, e.g., polyacrylic acid compounds, vegetable gums, and cellulose based compounds. Specific examples of suitable viscosity modifiers include polyacrylic acid, methyl cellulose, polyethyleneoxide, guar gum, locust bean gum, sodium carboxymethylcellulose, sodium alginate, and gum tragacanth. The viscosity of the viscosity-adjusted casting mixture can be further increased, i.e., beyond the minimum viscosity, on an application by application basis to adapt the dielectric composite material to the selected laminating technique. In an embodiment, the viscosity-adjusted casting mixture can exhibit a viscosity of 10 to 100,000 centipoise (cp); specifically, 100 cp and 10,000 cp measured at room temperature value.

Alternatively, the viscosity modifier can be omitted if the viscosity of the carrier liquid is sufficient to provide a casting mixture that does not separate during the time period of interest. Specifically, in the case of extremely small particles, e.g., particles having an equivalent spherical diameter less than 0.1 micrometers, the use of a viscosity modifier may not be necessary.

A layer of the viscosity-adjusted casting mixture can be cast onto the magnetic layer, or can be dip-coated. The casting can be achieved by, for example, dip coating, flow coating, reverse roll coating, knife-over-roll, knife-over-plate, metering rod coating, and the like.

The carrier liquid and processing aids, i.e., the surfactant and viscosity modifier, can be removed from the cast layer, for example, by evaporation and/or by thermal decomposition in order to consolidate a dielectric layer of the polymer and any filler.

The layer of the polymeric matrix material and filler component can be further heated to modify the physical properties of the layer, e.g., to sinter a thermoplastic or to cure and/or post cure a thermosetting.

In another method, a PTFE composite dielectric layer can be made by a paste extrusion and calendaring process.

In still another embodiment, the dielectric layer can be cast and then partially cured ("B-staged"). Such B-staged layers can be stored and used subsequently, e.g., in lamination processes.

In an embodiment, a multiple-step process suitable for thermosetting materials such as polybutadiene and/or polyisoprene can comprise a peroxide cure step at temperatures of 150 to 200° C., and the partially cured stack can then be subjected to a high-energy electron beam irradiation cure (E-beam cure) or a high temperature cure step under an inert atmosphere. Use of a two-stage cure can impart an unusually high degree of cross-linking to the resulting laminate. The temperature used in the second stage can be 250 to 300° C., or the decomposition temperature of the polymer. This high temperature cure can be carried out in an oven but can also be performed in a press, namely as a continuation of the initial lamination and cure step. Particular lamination temperatures and pressures will depend upon the particular adhesive composition and the substrate composition, and are readily ascertainable by one of ordinary skill in the art without undue experimentation.

While certain embodiments of the array apparatus 100 have been described herein with reference to certain values for the volume, thickness, dielectric constant and tangent loss factor of the resonators 200 and encapsulating layer 800, it will be appreciated that these certain values are example values only, and that other values may be employed consistent with a purpose of the invention disclosed herein. Furthermore, while an array apparatus 100 has been described herein to have a certain size, and material characteristics, that was specifically chosen to resonate at 77 GHz, it will be appreciated that the scope of the invention is not so limited, and also encompasses an array apparatus having a different size to resonate at a different frequency while being suitable for a purpose disclosed herein.

It is contemplated that the array apparatus can be used in electronic devices such as inductors on electronic integrated circuit chips, electronic circuits, electronic packages, modules and housings, transducers, and UHF, VHF, and microwave antennas for a wide variety of applications, for example electric power applications, data storage, and microwave communication. Additionally, the array apparatus can be used with very good results (size and bandwidth) in antenna designs over the frequency range 20-100 GHz.

"Layer" as used herein includes planar films, sheets, and the like as well as other three-dimensional non-planar forms. A layer can further be macroscopically continuous or non-continuous. Use of the terms "a" and "an" do not denote a limitation of quantity, but rather denote the presence of at least one of the referenced item. Ranges disclosed herein are inclusive of the recited endpoint and are independently combinable. "Combination" is inclusive of blends, mixtures, alloys, reaction products, and the like. Also, "combinations comprising at least one of the foregoing" means that the list is inclusive of each element individually, as well as combinations of two or more elements of the list, and combinations of at least one elements of the list with like elements not named. The terms "first," "second," and so forth, herein do not denote any order, quantity, or importance, but rather are used to distinguish one element from another. As used herein, the term "substantially equal" means that the two values of comparison are plus or minus 10% of each other, specifically, plus or minus 5% of each other, more specifically, plus or minus 1% of each other.

While certain combinations of features relating to an antenna have been described herein, it will be appreciated that these certain combinations are for illustration purposes only and that any combination of any of these features may be employed, explicitly or equivalently, either individually or in combination with any other of the features disclosed herein, in any combination, and all in accordance with an embodiment. Any and all such combinations are contemplated herein and are considered within the scope of the disclosure.

While the invention has been described with reference to exemplary embodiments, it will be understood by those skilled in the art that various changes may be made and equivalents may be substituted for elements thereof without departing from the scope of this disclosure. In addition, many modifications may be made to adapt a particular situation or material to the teachings without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments and, although specific terms may have been employed, they are unless otherwise stated used in a generic and descriptive sense only and not for purposes of limitation.

The invention claimed is:

1. An array apparatus, comprising:

an electrically conductive ground layer;

a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer;

a plurality of spaced apart signal feeds disposed in one-to-one relationship with respective ones of the plurality of resonators;

wherein each respective signal feed provides a respective electrical signal path through respective ones of the plurality of resonators that defines an orientation of a resulting magnetic dipole vector associated with the corresponding ones of the plurality of resonators when an electrical signal is present on the corresponding ones of the plurality of signal feeds; and wherein each pair of closest adjacent ones of the resulting magnetic dipole vectors are oriented parallel with each other but not in linear alignment with each other.

2. The apparatus of claim 1, wherein:

each respective signal feed has a feed direction disposed in linear alignment with corresponding ones of the resulting magnetic dipole vectors.

3. The apparatus of claim 2, wherein:

each respective electrical signal path has a defined orientation that is orthogonal to the corresponding magnetic dipole vector; and each pair of closest adjacent ones of the corresponding electrical signal paths have orientations that are parallel with each other but not in linear alignment with each other.

4. The apparatus of claim 2, further comprising:

a low dielectric material encapsulating the plurality of resonators with respect to the ground layer, the low dielectric material having a dielectric constant that is less than a respective dielectric constant of the plurality of resonators.

5. The apparatus of claim 2, wherein:

the ground layer has a rectangular outer perimeter.

6. The apparatus of claim 1, wherein:

the plurality of resonators are uniformly spaced apart a first distance with respect to the x-axis and a second distance with respect to the y-axis, of the x, y grid, to form a periodic structure where the first distance is equal to the second distance.

7. The apparatus of claim 1, wherein:

each one of the plurality of signal feeds comprises a feed structure according to any one of: a substrate integrated waveguide; a coplanar waveguide; or, any combination of the foregoing feed structures.

8. The apparatus of claim 1, wherein:

each one of the plurality of signal feeds comprises a feed structure according to any one of: a stripline; a microstrip; or, any combination of the foregoing feed structures.

9. The apparatus of claim 1, wherein:

the defined radiation wavelength of the plurality of spaced apart resonators correlates with an operating frequency equal to or greater than 20 GHz and equal to or less than 100 GHz.

10. The apparatus of claim 1, wherein:

each one of the plurality of resonators has an axial cross section in the shape of: a circle; a rectangle; a polygon; a ring; or, an ellipsoid.

11. The apparatus of claim 1, wherein:

each one of the plurality of resonators has a three-dimensional solid form in the shape of: a cylinder; a polygon box; a tapered polygon box; a cone; a truncated cone; a half-toroid; or, a half-sphere.

12. The apparatus of claim 1, wherein:

each one of the plurality of resonators comprises a respective material having a dielectric constant equal to or greater than 10 and a loss tangent dissipation factor equal to or less than 0.002.

13. The apparatus of claim 1, wherein:

each one of the plurality of resonators comprises a respective material having a dielectric constant equal to or greater than 20 and a loss tangent dissipation factor equal to or less than 0.002.

14. The apparatus of claim 1, wherein:

the plurality of resonators are spaced apart on the x, y grid having respective x and y dimensions between the closest adjacent resonators that are each less than one-half the defined radiation wavelength.

15. The apparatus of claim 1, wherein:

the electrical signal comprises a 77 GHz signal communicated in phase to each of the plurality of resonators via respective ones of the plurality of signal feeds, and the apparatus is configured to and is capable of radiating the 77 GHz signal into free space with a boresight gain of at least 17 dB.

16. The apparatus of claim 1, wherein:

the electrical signal comprises a 77 GHz signal communicated in phase to each of the plurality of resonators via respective ones of the plurality of signal feeds, and the apparatus is configured to and is capable of radiating the 77 GHz signal into free space with a boresight gain of at least 23 dB.

17. The apparatus of claim 1, wherein:

the electrical signal comprises a 77 GHz signal communicated in phase to each of the plurality of resonators via respective ones of the plurality of signal feeds, and the apparatus is configured to and is capable of radiating the 77 GHz signal into free space with a return loss S11 of at least −30 dB.

18. The apparatus of claim 1, wherein:

the plurality of spaced apart dielectric resonators comprises four or more resonators.

19. The apparatus of claim 1, wherein:

the ground layer comprises a plurality of non-conductive pathways disposed in one-to-one relationship with respective ones of the plurality of signal feeds that provide for signal communication from one side of the ground layer to the other side of the ground layer on which the plurality of resonators are disposed.

20. The apparatus of claim 19, wherein:

the plurality of non-conductive pathways are respective through-slots that extend from the one side of the ground layer to the other side of the ground layer.

21. The apparatus of claim 1, wherein:

each one of the plurality of signal feeds comprises a respective slotted aperture; and each pair of closest adjacent ones of the slotted aperture associated with corresponding ones of the plurality of resonators are lengthwise oriented parallel with each other but not in linear alignment with each other.

22. The apparatus of claim 21, wherein:

respective ones of the slotted aperture and corresponding ones of the resulting magnetic dipole vector are in linear alignment with each other.

23. An array apparatus, comprising:

an electrically conductive ground layer;

a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer;

a plurality of spaced apart signal feeds disposed in one-to-one relationship with respective ones of the plurality of resonators, wherein each one of the plurality of signal feeds comprises a respective slotted aperture;

wherein each respective signal feed provides a respective electrical signal path through respective ones of the plurality of resonators that defines an orientation of a resulting magnetic dipole vector associated with the corresponding ones of the plurality of resonators when an electrical signal is present on the corresponding ones of the plurality of signal feeds; and wherein each pair of closest adjacent ones of the resulting magnetic dipole vectors are oriented parallel with each other but not in linear alignment with each other.

24. The apparatus of claim 23, wherein:

each pair of closest adjacent ones of the slotted aperture associated with corresponding ones of the plurality of resonators are lengthwise oriented parallel with each other but not in linear alignment with each other.

25. An array apparatus, comprising:

an electrically conductive ground layer;

a plurality of spaced apart dielectric resonators operable at a defined radiation wavelength, the plurality of resonators being spaced apart on an x, y grid having respective x and y dimensions between closest adjacent resonators that are each less than the defined radiation wavelength, each resonator being disposed on and in electrical communication with the ground layer;

a plurality of spaced apart signal feeds disposed in one-to-one relationship with respective ones of the plurality of resonators, wherein each one of the plurality of signal feeds comprises a respective slotted aperture; and wherein each pair of closest adjacent ones of the slotted aperture associated with corresponding ones of the plurality of resonators are lengthwise oriented parallel with each other but not in linear alignment with each other.

26. The apparatus of claim 25, wherein:

the ground layer comprises a plurality of non-conductive pathways disposed in one-to-one relationship with respective ones of the plurality of signal feeds that provide for signal communication from one side of the ground layer to the other side of the ground layer on which the plurality of resonators are disposed.

27. The apparatus of claim 25, wherein:

the plurality of resonators are uniformly spaced apart a first distance with respect to the x-axis and a second distance with respect to the y-axis, of the x, y grid, to form a periodic structure where the first distance is equal to the second distance.

28. The apparatus of claim 25, wherein:

each one of the plurality of resonators has an axial cross section in the shape of: a circle; a rectangle; a polygon; a ring; or, an ellipsoid.

29. The apparatus of claim 25, wherein:

each one of the plurality of resonators has a three-dimensional solid form in the shape of: a cylinder; a polygon box; a tapered polygon box; a cone; a truncated cone; a half-toroid; or, a half-sphere.

30. The apparatus of claim 25, wherein:

each one of the plurality of resonators comprises a respective material having a dielectric constant equal to or greater than 10 and a loss tangent dissipation factor equal to or less than 0.002.

31. The apparatus of claim 25, wherein:

each one of the plurality of resonators comprises a respective material having a dielectric constant equal to or greater than 20 and a loss tangent dissipation factor equal to or less than 0.002.

32. The apparatus of claim 25, wherein:

when a 77 GHz signal is communicated in phase to each of the plurality of resonators via respective ones of the plurality of signal feeds, the apparatus is configured to and is capable of radiating the 77 GHz signal into free space with a boresight gain of at least 17 dB.

33. The apparatus of claim 25, wherein:

when a 77 GHz signal is communicated in phase to each of the plurality of resonators via respective ones of the plurality of signal feeds, the apparatus is configured to and is capable of radiating the 77 GHz signal into free space with a boresight gain of at least 23 dB.

34. The apparatus of claim 25, wherein:

when a 77 GHz signal is communicated in phase to each of the plurality of resonators via respective ones of the plurality of signal feeds, the apparatus is configured to and is capable of radiating the 77 GHz signal into free space with a return loss S11 of at least −30 dB.

35. The apparatus of claim 25, wherein:

the plurality of spaced apart dielectric resonators comprises four or more resonators.

36. The apparatus of claim 25, wherein:

the defined radiation wavelength of the plurality of spaced apart resonators correlates with an operating frequency equal to or greater than 20 GHz and equal to or less than 100 GHz.

37. The apparatus of claim 25, wherein:

the plurality of resonators are spaced apart on the x, y grid having respective x and y dimensions between the closest adjacent resonators that are each less than one-half the defined radiation wavelength.

* * * * *